US010412522B2

(12) United States Patent
Sen et al.

(10) Patent No.: US 10,412,522 B2
(45) Date of Patent: Sep. 10, 2019

(54) INSERTING AUDIO CHANNELS INTO DESCRIPTIONS OF SOUNDFIELDS

(71) Applicant: QUALCOMM Incorporated, San Diego, CA (US)

(72) Inventors: Dipanjan Sen, San Diego, CA (US); Nils Günther Peters, San Diego, CA (US)

(73) Assignee: Qualcomm Incorporated, San Diego ( * ) Notice: Subject to any disclaimer, the term of this patent is extended or adjusted under 35 U.S.C. 154(b) by 224 days.

(21) Appl. No.: 14/663,225

(22) Filed: Mar. 19, 2015

(65) Prior Publication Data

US 2015/0271621 A1 Sep. 24, 2015

Related U.S. Application Data

(60) Provisional application No. 61/969,011, filed on Mar. 21, 2014, provisional application No. 61/969,586, filed on Mar. 24, 2014.

(51) Int. Cl.

| | |
|---|---|
| ***H04S 7/00*** | (2006.01) |
| ***G10L 19/008*** | (2013.01) |
| *G10L 25/48* | (2013.01) |
| *G10L 19/018* | (2013.01) |

(52) U.S. Cl.

CPC ..... *H04S 7/30* (2013.01); *G10L 19/008* (2013.01); *G10L 19/018* (2013.01); *G10L 25/48* (2013.01)

(58) Field of Classification Search

None

See application file for complete search history.

(56) References Cited

U.S. PATENT DOCUMENTS

2011/0249821 A1 10/2011 Jaillet et al.
2013/0010971 A1* 1/2013 Batke ..... G10L 19/008 381/22
2013/0148812 A1* 6/2013 Corteel ..... H04S 7/30 381/17
2013/0216070 A1* 8/2013 Keiler ..... G10L 19/008 381/300
2013/0223658 A1* 8/2013 Betlehem ..... H04S 3/002 381/307

(Continued)

FOREIGN PATENT DOCUMENTS

EP 2450880 A1 * 5/2012 ..... G10L 19/008
JP 2013545391 A 12/2013

(Continued)

OTHER PUBLICATIONS

Second Written Opinion from International Application No. PCT/US2015/021806, dated Apr. 4, 2016, 7 pp.

(Continued)

*Primary Examiner* — Paul W Huber
(74) *Attorney, Agent, or Firm* — Shumaker & Sieffert, P.A.

(57) ABSTRACT

In general, techniques are described for inserting audio channels into descriptions of soundfields. A device comprising a processor may be configured to perform the techniques. The processor may be configured to obtain an audio channel separate from a higher-order ambisonic representation of a soundfield. The processor may further be configured to insert the audio channel at a spatial location within the soundfield such that the audio channel is able to be extracted from the soundfield.

33 Claims, 13 Drawing Sheets

(56) References Cited

U.S. PATENT DOCUMENTS

| | | | | |
|---|---|---|---|---|
| 2014/0016786 | A1* | 1/2014 | Sen | G10L 19/008 381/23 |
| 2014/0133683 | A1 | 5/2014 | Robinson et al. | |
| 2014/0219455 | A1 | 8/2014 | Peters et al. | |
| 2015/0213803 | A1 | 7/2015 | Peters et al. | |
| 2015/0230040 | A1* | 8/2015 | Squires | H04S 7/306 381/303 |

FOREIGN PATENT DOCUMENTS

| | | | |
|---|---|---|---|
| JP | 2015520411 | A | 7/2015 |
| JP | 2015527610 | A | 9/2015 |
| WO | 2011104418 | A1 | 9/2011 |
| WO | 2013171083 | A1 | 11/2013 |
| WO | 2014013070 | A1 | 1/2014 |
| WO | 2014035864 | A1 | 3/2014 |
| WO | 2014194099 | A1 | 12/2014 |

OTHER PUBLICATIONS

Response to Written Opinion dated Apr. 4, 2016, from International Application No. PCT/US2015/021806, filed on Jun. 3, 2016, 16 pp.
International Search Report and Written Opinion from International Application No. PCT/US2015/021806, dated Jul. 2, 2015, 11 pp.
Nishimura, "Audio Watermarking Using Spatial Masking and Ambisonics", IEEE Transactions on Audio, Speech and Language Processing, IEEE Service Center, New York, NY, USA, vol. 20, No. 9, Nov. 1, 2012, pp. 2461-2469, XP011471463.
Nishimura., "Audio Information Hiding Based on Spatial Masking", 2010 Sixth International Conference on Intelligent Information Hiding and Multimedia Signal Processing (IIH-MSP), IEEE, Piscataway, NJ, USA, Oct. 15, 2010, pp. 522-525, XP031801765.
Stenzel, et al., "Producing Interactive Immersive Sound for MPEG-H: A Field Test for Sports Broadcasting," AES 137th Convention, Oct. 9-12, 2014, 12 pp.
"WD1-HOA Text of MPEG-H 3D Audio", 107. MPEG Meeting; Jan. 13-17, 2014; San Jose; (Motion Picture Expert Group or ISO/IEC JTC1/SC29/WG11), No. N14264, Feb. 21, 2014, XP030021001, 84 pp.
"Call for Proposals for 3D Audio," ISO/IEC JTC1/SC29/WG11/N13411, Jan. 2013, 20 pp.
Hollerweger, "An Introduction to Higher Order Ambisonic," Oct. 2008, 13 pp.
Poletti, "Three-Dimensional Surround Sound Systems Based on Spherical Harmonics," J. Audio Eng. Soc. vol. 53, No. 11, Nov. 2005, pp. 1004-1025.
Response to Written Opionion dated Jul. 2, 2015, from International Application No. PCT/US2015/021806, filed on Jan. 20, 2016, 17 pp.
Herre, et al., "MPEG-H 3D Audio—The New Standard for Coding of Immersive Spatial Audio," IEEE Journal of Selected Topics in Signal Processing, vol. 9, No. 5, Aug. 2015, pp. 770-779.
"Information technology—High efficiency coding and media delivery in heterogeneous environments—Part 3: Part 3: 3D Audio, Amendment 3: MPEG-H 3D Audio Phase 2," ISO/IEC JTC 1/SC 29N, Jul. 25, 2015, 208 pp.
"Information technology—High efficiency coding and media delivery in heterogeneous environments—Part 3: 3D Audio," ISO/IEC JTC 1/SC 29N, Apr. 4, 2014, 337 pp.
"Information technology—High efficiency coding and media delivery in heterogeneous environments—Part 3: 3D Audio," ISO/IEC JTC 1/SC 29, Jul. 25, 2014, 311 pp.
Hellerud, et al., "Encoding Higher Order Ambisonics with AAC," presented at the 124th Convention, May 17-20, 2008, 9 pp.
Menzies, "Neartield Synthesis of Complex Sources with Higher-Order Ambisonics, and Binaural Rendering," presented at the Proceedings of the 13th International Conference on Auditory Display held in Montreal, Canada, Jun. 26-29, 2007, 8 pp.
International Preliminary Report on Patentability from International Application No. PCT/US2015/021806, The International Bureau of WIPO, dated Jun. 30, 2016, 7 pp.
Jot, et al., "Beyond Surround Sound—Creation, Coding and Reproduction of 3-D Audio Soundtracks," AES Convention 131, Oct. 20-23, 2011, New York, NY, Paper No. 8463, 11 pp.
Iwatani Y., et al., "Sound Field Representation by Spherical Harmonic Analysis," The Journal of The Acoustical Society of Japan, Nov. 2011, vol. 67, No. 11, pp. 544-549.

* cited by examiner

INSERTING AUDIO CHANNELS INTO DESCRIPTIONS OF SOUNDFIELDS

This application claims the benefit of U.S. Provisional Application No. 61/969,011 filed Mar. 21, 2014, entitled "INSERTING AUDIO CHANNELS INTO DESCRIPTIONS OF SOUNDFIELDS," and U.S. Provisional Application No. 61/969,586, filed Mar. 24, 2014, entitled "INSERTING AUDIO CHANNELS INTO DESCRIPTIONS OF SOUNDFIELDS," each of which is hereby incorporated by reference in its entirety herein.

TECHNICAL FIELD

This disclosure relates to audio data and, more specifically, coding of higher-order ambisonic audio data.

BACKGROUND

A higher-order ambisonics (HOA) signal (often represented by a plurality of spherical harmonic coefficients (SHC) or other hierarchical elements) is a three-dimensional representation of a soundfield. The HOA or SHC representation may represent the soundfield in a manner that is independent of the local speaker geometry used to playback a multi-channel audio signal rendered from the SHC signal. The SHC signal may also facilitate backwards compatibility as the SHC signal may be rendered to well-known and highly adopted multi-channel formats, such as, for example, a 5.1 audio channel format or a 7.1 audio channel format. The SHC representation may therefore enable a better representation of a soundfield that also accommodates backward compatibility.

SUMMARY

In general, this disclosure describes techniques for coding of higher-order ambisonics audio data. Higher-order ambisonics audio data may comprise at least one higher-order ambisonic (HOA) coefficient corresponding to a spherical harmonic basis function having an order greater than one.

In one aspect, a device comprises one or more processors configured to obtain an augmented higher-order ambisonic representation of a soundfield that includes an audio channel separate from the soundfield, and extract an audio channel from a spatial location within the augmented higher-order ambisonic representation of the soundfield.

In another aspect, a method comprises obtaining an augmented higher-order ambisonic representation of a soundfield that includes an audio channel separate from the soundfield, and extracting an audio channel from a spatial location within the augmented higher-order ambisonic representation of the soundfield.

In another aspect, a device comprises one or more processors configured to obtain an audio channel separate from a higher-order ambisonic representation of a soundfield, and insert the audio channel at a spatial location within the soundfield such that the audio channel is able to be extracted from the soundfield.

In another aspect, a method comprises obtaining an audio channel separate from a higher-order ambisonic representation of a soundfield, and inserting the audio channel at a spatial location within the soundfield such that the audio channel is able to be extracted from the soundfield.

The details of one or more aspects of the techniques are set forth in the accompanying drawings and the description below. Other features, objects, and advantages of the techniques will be apparent from the description and drawings, and from the claims.

DETAILED DESCRIPTION

Figure 1:
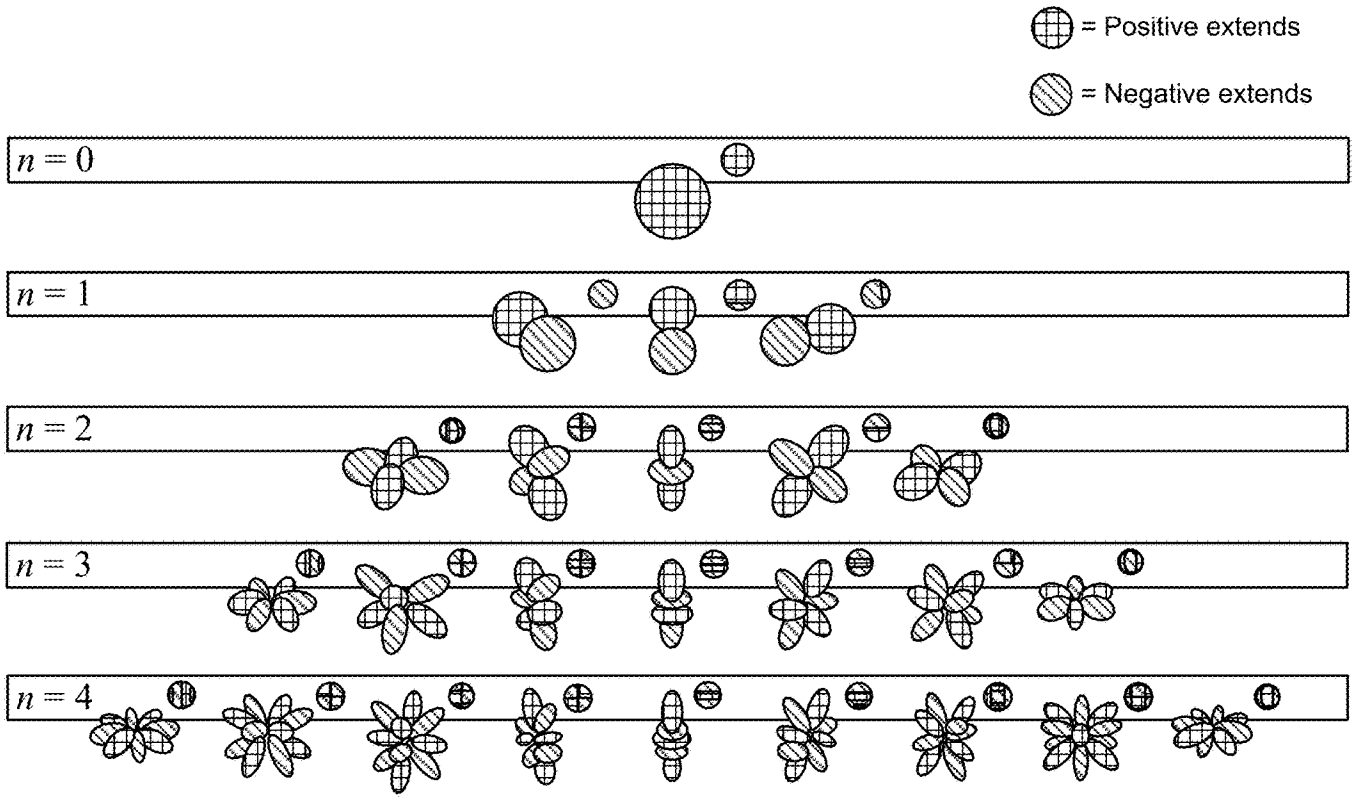
FIG. 1 is a diagram illustrating spherical harmonic basis functions of various orders and sub-orders.

The evolution of surround sound has made available many output formats for entertainment. Examples of such consumer surround sound formats are mostly 'channel' based in that they implicitly specify feeds to loudspeakers in certain geometrical coordinates. The consumer surround sound formats include the popular 5.1 format (which includes the following six channels: front left (FL), front right (FR), center or front center, back left or surround left, back right or surround right, and low frequency effects (LFE)), the growing 7.1 format, and various formats that include height speakers such as the 7.1.4 format and the 22.2 format (e.g., for use with the Ultra High Definition Television standard). Non-consumer formats can span any number of speakers (in symmetric and non-symmetric geometries), often termed 'surround arrays'. One example of such an array includes 32 loudspeakers positioned on coordinates on the corners of a truncated icosahedron.

The input to a future MPEG encoder is optionally one of three possible formats: (i) traditional channel-based audio (as discussed above), which is meant to be played through loudspeakers at pre-specified positions; (ii) object-based audio, which involves discrete pulse-code-modulation (PCM) data for single audio objects with associated metadata containing their location coordinates (amongst other information); and (iii) scene-based audio, which involves representing the soundfield using coefficients of spherical harmonic basis functions (also called "spherical harmonic coefficients" or SHC, "Higher-order Ambisonics" or HOA, and "HOA coefficients"). Additional details of the future MPEG encoder may be found in a document entitled "Call for Proposals for 3D Audio," by the International Organization for Standardization/International Electrotechnical Commission (ISO)/(IEC) JTC1/SC29/WG11/N13411, released January 2013 in Geneva, Switzerland, and available at http://mpeg.chiariglione.org/sites/default/files/files/standards/parts/docs/w13411.zip.

Various 'surround-sound' channel-based formats are available. They range, for example, from the 5.1 home theater system (which has been the most successful in terms of making inroads into living rooms beyond stereo) to the 22.2 system developed by NHK (Nippon Hoso Kyokai or Japan Broadcasting Corporation). Content creators (e.g., Hollywood studios) would like to produce the soundtrack for a movie once, and not spend effort to remix it for each speaker configuration. Recently, standards developing organizations have been considering ways in which to provide an encoding into a standardized bitstream and a subsequent decoding that is adaptable and agnostic to the speaker geometry (and number) and acoustic conditions at the location of the playback (involving a renderer).

To provide such flexibility for content creators, a hierarchical set of elements may be used to represent a soundfield. The hierarchical set of elements may refer to a set of elements in which the elements are ordered such that a basic set of lower-ordered elements provides a full representation of the modeled soundfield. As the set is extended to include higher-order elements, the representation becomes more detailed, increasing resolution.

One example of a hierarchical set of elements is a set of spherical harmonic coefficients (SHC). The following expression demonstrates a description or representation of a soundfield using SHC:

$$p_i(t, r_r, \theta_r, \varphi_r) = \sum_{\omega=0}^{\infty}\left[4\pi\sum_{n=0}^{\infty} j_n(kr_r)\sum_{m=-n}^{n} A_n^m(k)Y_n^m(\theta_r, \varphi_r)\right]e^{j\omega t},$$

The expression shows that the pressure $p_i$ at any point $\{r_r,\theta_r,\varphi_r\}$ of the soundfield, at time t, can be represented uniquely by the SHC, $A_n^m(k)$. Here, $k=\omega/c$, c is the speed of sound (~343 m/s), $\{r_r,\theta_r,\varphi_r\}$ is a point of reference (or observation point), $j_n(\bullet)$ is the spherical Bessel function of order n, and $Y_n^m(\theta_r,\varphi_r)$ are the spherical harmonic basis functions of order n and suborder m. The term in square brackets is a frequency-domain representation of the signal (i.e., $S(\omega,r_r,\theta_r,\varphi_r)$) which can be approximated by various time-frequency transformations, such as the discrete Fourier transform (DFT), the discrete cosine transform (DCT), or a wavelet transform. Other examples of hierarchical sets include sets of wavelet transform coefficients and other sets of coefficients of multiresolution basis functions.

FIG. 1 is a diagram illustrating spherical harmonic basis functions from the zero order (n=0) to the fourth order (n=4). As can be seen, for each order, there is an expansion of suborders m which are shown but not explicitly noted in the example of FIG. 1 for ease of illustration purposes.

The SHC $A_n^m(k)$ can either be physically acquired (e.g., recorded) by various microphone array configurations or, alternatively, they can be derived from channel-based or object-based descriptions of the soundfield. The SHCs represent scene-based audio, where the SHCs may be input to an audio encoder to obtain encoded SHCs that may promote more efficient transmission or storage. For example, a fourth-order representation involving $(1+4)^2$ (25, and hence fourth order) coefficients may be used.

As noted above, the SHC may be derived from a microphone recording using a microphone array. Various examples of how SHCs may be derived from microphone arrays are described in Poletti, M., "Three-Dimensional Surround Sound Systems Based on Spherical Harmonics," J. Audio Eng. Soc., Vol. 53, No. 11, 2005 November, pp. 1004-1025.

To illustrate how the SHCs may be derived from an object-based description, consider the following equation. The coefficients $A_n^m(k)$ for the soundfield corresponding to an individual audio object may be expressed as:

$$A_n^m(k)=g(\omega)(-4\pi k)h_n^{(2)}(kr_s)Y_n^{m*}(\theta_s,\varphi_s),$$

where i is $\sqrt{-1}$, $h_n^{(2)}(\bullet)$ is the spherical Hankel function (of the second kind) of order n, and $\{r_s,\theta_s,\varphi_s\}$ is the location of the object. Knowing the object source energy $g(\omega)$ as a function of frequency (e.g., using time-frequency analysis techniques, such as performing a fast Fourier transform on the PCM stream) allows us to convert each PCM object and the corresponding location into the SHC $A_n^m(k)$. Further, it can be shown (since the above is a linear and orthogonal decomposition) that the $A_n^m(k)$ coefficients for each object are additive. In this manner, a multitude of PCM objects can be represented by the $A_n^m(k)$ coefficients (e.g., as a sum of the coefficient vectors for the individual objects). Essentially, the coefficients contain information about the soundfield (the pressure as a function of 3D coordinates), and the above represents the transformation from individual objects to a representation of the overall soundfield, in the vicinity of the observation point $\{r_r,\theta_r,\varphi_r\}$. The remaining figures are described below in the context of object-based and SHC-based audio coding.

Figure 2:
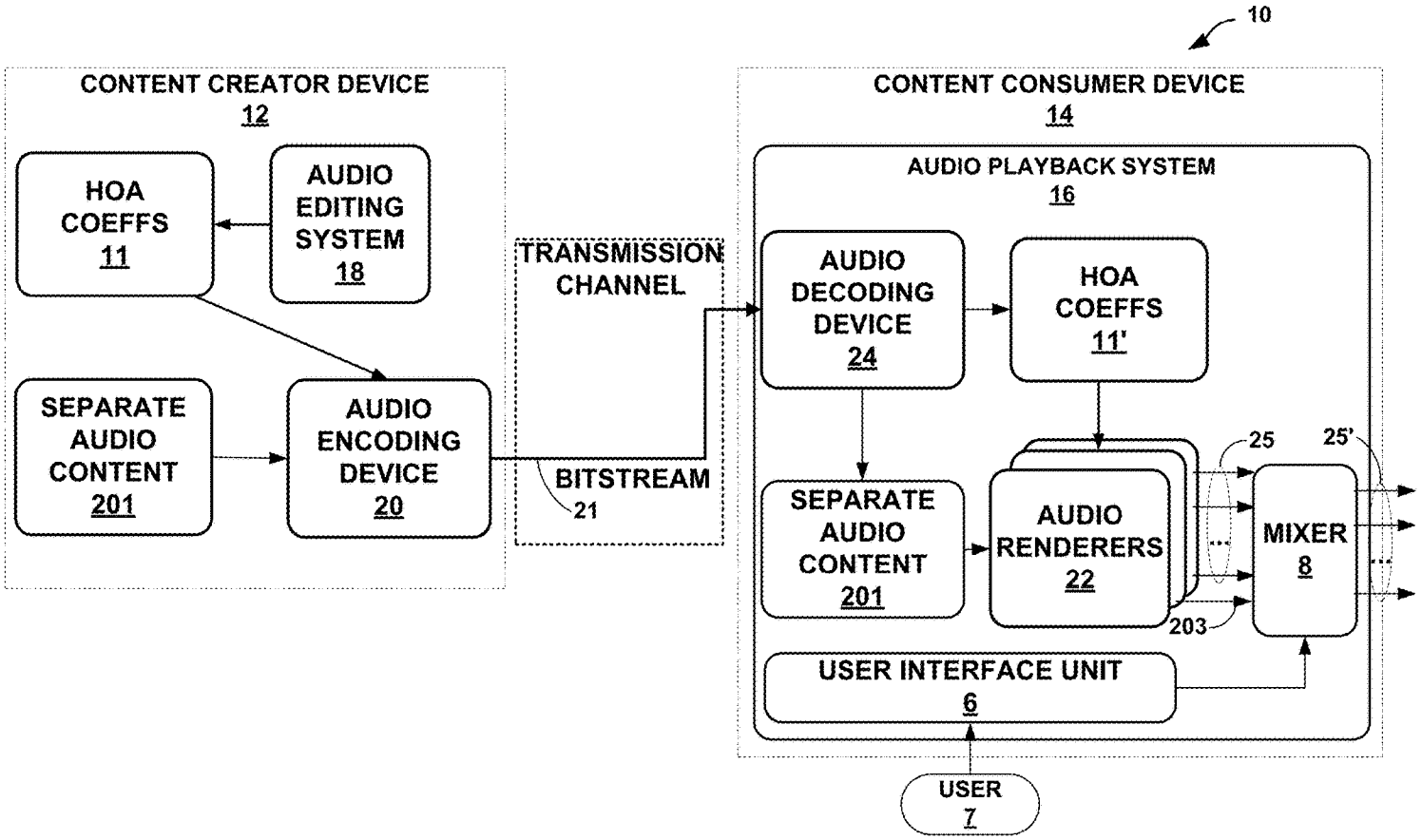
FIG. 2 is a diagram illustrating a system that may perform various aspects of the techniques described in this disclosure.

FIG. 2 is a diagram illustrating a system 10 that may perform various aspects of the techniques described in this disclosure. As shown in the example of FIG. 2, the system 10 includes a content creator device 12 and a content consumer device 14. While described in the context of the content creator device 12 and the content consumer device 14, the techniques may be implemented in any context in which SHCs (which may also be referred to as HOA coefficients) or any other hierarchical representation of a soundfield are encoded to form a bitstream representative of the audio data. Moreover, the content creator device 12 may represent any form of computing device capable of implementing the techniques described in this disclosure, including a handset (or cellular phone), a tablet computer, a smart phone, a set-top box, a television, an audio receiver, a portable computer or a desktop computer to provide a few examples. Likewise, the content consumer device 14 may represent any form of computing device capable of implementing the techniques described in this disclosure, including a handset (or cellular phone), a tablet computer, a smart phone, a set-top box, a television, an audio receiver, a portable computer or a desktop computer to provide a few examples.

The content creator device 12 may be operated by a movie or television studio or other entity that may generate multichannel audio content for consumption by operators of content consumer devices, such as the content consumer device 14. In some examples, the content creator device 12 may be operated by an individual user who would like to compress HOA coefficients 11. In some examples, the content creator device 12 may augment HOA coefficients 11 with separate audio content 201 (such as commentary). Often, the content creator generates audio content in conjunction with video content. The content consumer device 14 may be operated by an individual, e.g., a user 7. The content consumer device 14 may include an audio playback system 16, which may refer to any form of audio playback system capable of rendering SHC for playback as multi-channel audio content.

The content creator device 12 includes an audio editing system 18. The content creator device 12 may obtain live recordings in various formats (including directly as HOA coefficients) and audio objects, which the content creator device 12 may edit using audio editing system 18. The content creator may, during the editing process, render HOA coefficients 11 from audio objects 9, listening to the rendered speaker feeds in an attempt to identify various aspects of the soundfield that require further editing. The content creator device 12 may then edit HOA coefficients 11 (potentially indirectly through manipulation of different ones of the audio objects 9 from which the source HOA coefficients may be derived in the manner described above). The content creator device 12 may employ the audio editing system 18 to generate the HOA coefficients 11. The audio editing system 18 represents any system capable of editing audio data and outputting the audio data as one or more source spherical harmonic coefficients.

When the editing process is complete, the content creator device 12 may generate a bitstream 21 based on the HOA coefficients 11. That is, the content creator device 12 includes an audio encoding device 20 that represents a device configured to encode or otherwise compress HOA coefficients 11 in accordance with various aspects of the techniques described in this disclosure to generate the bitstream 21. The audio encoding device 20 may generate the bitstream 21 for transmission, as one example, across a transmission channel, which may be a wired or wireless channel, a data storage device, or the like. The bitstream 21 may represent an encoded version of the HOA coefficients 11 and may include a primary bitstream and another side bitstream, which may be referred to as side channel information.

While shown in FIG. 2 as being directly transmitted to the content consumer device 14, the content creator device 12 may output the bitstream 21 to an intermediate device positioned between the content creator device 12 and the content consumer device 14. The intermediate device may store the bitstream 21 for later delivery to the content consumer device 14, which may request the bitstream. The intermediate device may comprise a file server, a web server, a desktop computer, a laptop computer, a tablet computer, a mobile phone, a smart phone, or any other device capable of storing the bitstream 21 for later retrieval by an audio decoder. The intermediate device may reside in a content delivery network capable of streaming the bitstream 21 (and possibly in conjunction with transmitting a corresponding video data bitstream) to subscribers, such as the content consumer device 14, requesting the bitstream 21.

Alternatively, the content creator device 12 may store the bitstream 21 to a storage medium, such as a compact disc, a digital video disc, a high definition video disc or other storage media, most of which are capable of being read by a computer and therefore may be referred to as computer-readable storage media or non-transitory computer-readable storage media. In this context, the transmission channel may refer to the channels by which content stored to the mediums are transmitted (and may include retail stores and other store-based delivery mechanism). In any event, the techniques of this disclosure should not therefore be limited in this respect to the example of FIG. 2.

As further shown in the example of FIG. 2, the content consumer device 14 includes the audio playback system 16. The audio playback system 16 may represent any audio playback system capable of playing back multi-channel audio data. The audio playback system 16 may include a number of different renderers 22. The renderers 22 may each provide for a different form of rendering, where the different forms of rendering may include one or more of the various ways of performing vector-base amplitude panning (VBAP), and/or one or more of the various ways of performing soundfield synthesis. As used herein, "A and/or B" means "A or B", or both "A and B".

The audio playback system 16 may further include an audio decoding device 24. The audio decoding device 24 may represent a device configured to decode the bitstream to produce HOA coefficients 11' and the separate audio content 201 from the bitstream 21. The HOA coefficients 11' may be similar to the HOA coefficients 11 but may differ due to lossy operations (e.g., quantization) and/or transmission via the transmission channel.

The audio playback system 16 may render the HOA coefficients 11' using one or more of audio renderers 22 to output loudspeaker feeds 25. The audio playback system 16 may render the separate audio content 201 using one or more of audio renderers 22 to output a separate loudspeaker feed 203. The audio playback system 16 may further include a mixer 8 that mixes the separate loudspeaker feed 203 with the loudspeaker feeds 25 to thereby generate mixed loudspeaker feeds 25'.

To select the appropriate renderer or, in some instances, generate an appropriate renderer, the audio playback system 16 may obtain loudspeaker information indicative of a number of loudspeakers and/or a spatial geometry of the loudspeakers. In some instances, the audio playback system 16 may obtain the loudspeaker information using a reference microphone and driving the loudspeakers in such a manner as to dynamically determine the loudspeaker information. In other instances or in conjunction with the dynamic determination of the loudspeaker information, the audio playback system 16 may prompt a user to interface with the audio playback system 16 and input the loudspeaker information.

The audio playback system 16 may then select one or more of the audio renderers 22 based on the loudspeaker information. In some instances, the audio playback system 16 may, when none of the audio renderers 22 are within some threshold similarity measure (in terms of the loudspeaker geometry) to the loudspeaker geometry specified in the loudspeaker information, generate the one of audio renderers 22 based on the loudspeaker information. The audio playback system 16 may, in some instances, generate one of the audio renderers 22 based on the loudspeaker information without first attempting to select an existing one of the audio renderers 22.

The audio playback system 16 also includes a user interface unit 6, which represent a unit by which a user 7 may interface with the audio playback system 16 (either graphically, via a remote control, via a text- and/or speech-based interface or the like). The user interface unit 6 may present various ways by which to control the volume of the loudspeaker feeds 25 and the separate audio content loudspeaker feed 203. The user 7 may enter commands to mute, unmute and/or increase or decrease the volume of the loudspeaker feed 203 separate from the loudspeaker feeds 25 rendered from the HOA coefficients 11'. Moreover, the user interface unit 6 may present the metadata associated with the separate audio channel 201 (which may be another way to refer to the separate audio content 201). The metadata may be specified in the separate audio channel 201 itself. The user interface unit 6 may present the metadata along with any other information describing the language, type, names of commentators/sportscasters, etc., relevant in identifying the separate audio channel 201. In the event, two or more separate audio channels 201 are provided, the user interface unit 6 may specify this information for each of the channels 201 to facilitate a user selecting between the various channels 201, separately muting or unmuting each of these channels 201, or increasing or decreasing the volume of each of these channels 201. Moreover, the user interface unit 6 may enable the user to select to which physical speakers the separate audio channel is to be mixed.

The user interface unit 6 may, upon receiving the user input, interface with the mixer 8 so that the mixer 8 may properly mix the separate loudspeaker channel 203 with the loudspeaker feeds 25 rendered from the HOA coefficients 11'. In this manner, the techniques may facilitate more granular user control over the separate loudspeaker channel 203.

In other words, one of the potential advantages of having separate dedicated audio channels, as cited by broadcasters, is the flexibility it may provide to the listeners in being able to potentially flexibly and interactively reduce the volume and/or select which language commentary to use. Provision of these extra commentary 'objects' typically requires extra bandwidth.

The solution provided by the various aspects of the techniques described in this disclosure may allow the extra channels to be embedded within HOA or SH channels. There is generally no extra bandwidth required for the reasons noted above, as these SH/HOA channels may be coded and transmitted as part of the SH/HOA coding scheme proposed in the new MPEG-H standard. The techniques may enable audio encoding devices to insert these objects sounds into the soundfield description represented by the SH/HOA coefficients, which usually represent background or ambient information. There are three exemplary ways of doing this:

1) Insert the object sounds into areas of the soundfield where there are spatial 'holes'. This requires a soundfield analysis at the encoder—and possibly transmitting the elevation/azimuth angles of 'where' the object was positioned;

2) Insert the object sounds into 'any' part of the soundfield—and rely on the decoder to separate the distinct/foreground object (using source separation algorithms such as SVD or other means) to be able to accurately extract them. This could also be aided by sending some information on where the audio object was inserted from the encoder; and 3) Force holes in the soundfield, the result of which will not impose any detrimental perceptual impact. The audio-objects would be placed within these spatial holes. The encoder would indicate where these holes were created, e.g., by sending 'metadata' to the decoder.

Figure 3A:
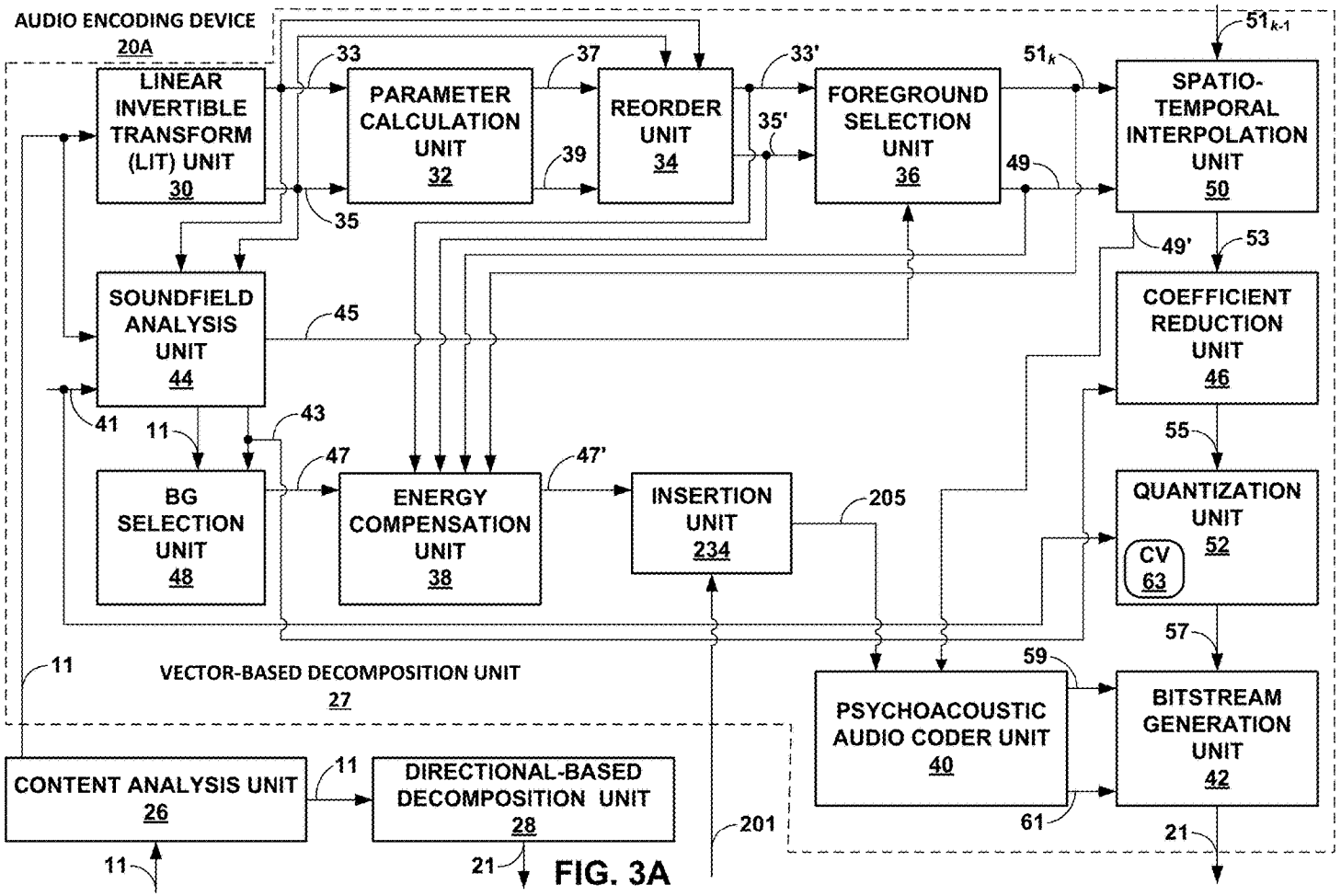
FIGS. 3A-3C are block diagrams illustrating various examples of the audio encoding device shown in FIG. 2 that may each perform various aspects of the techniques described in this disclosure.
Figure 3B:
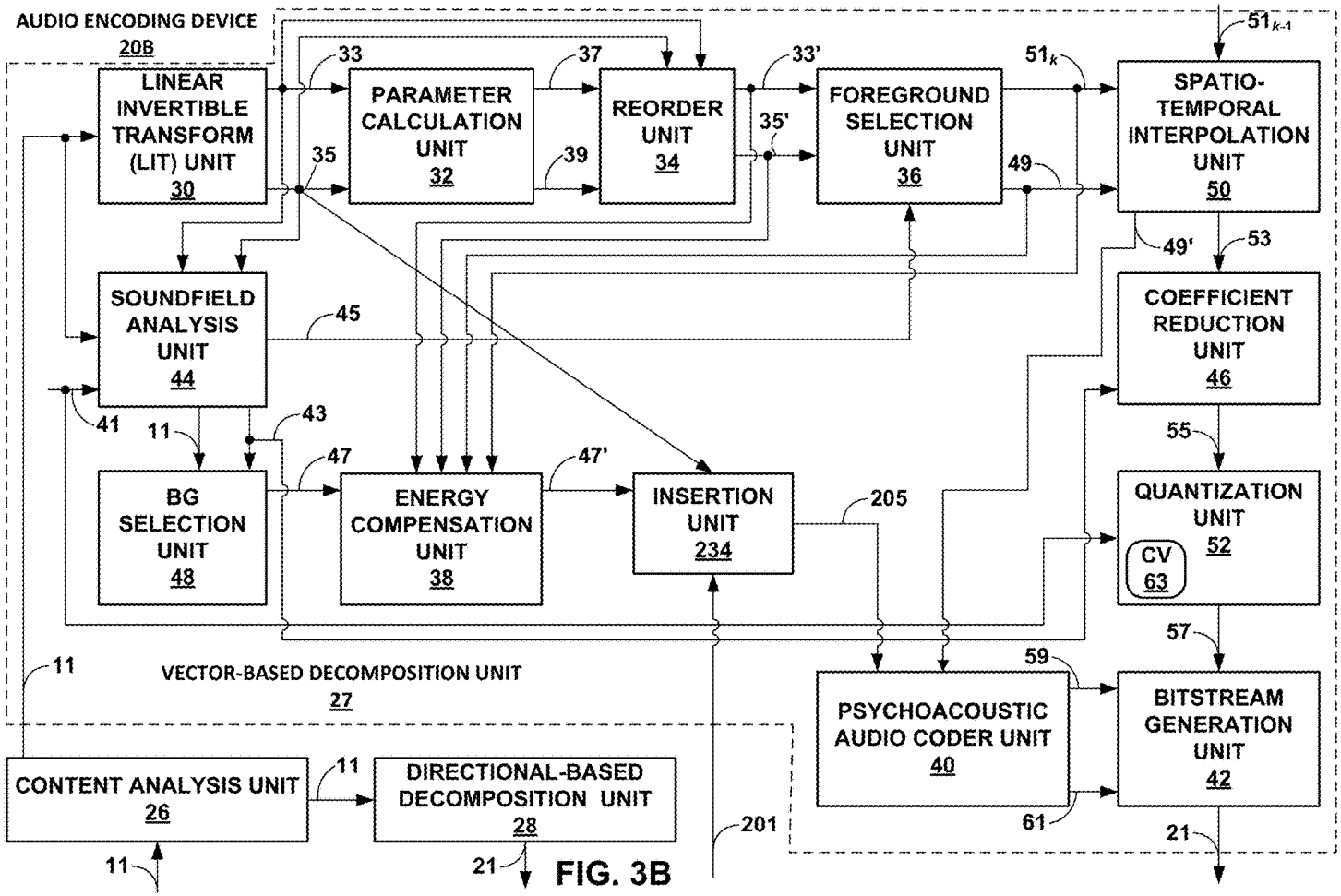
Figure 3C:
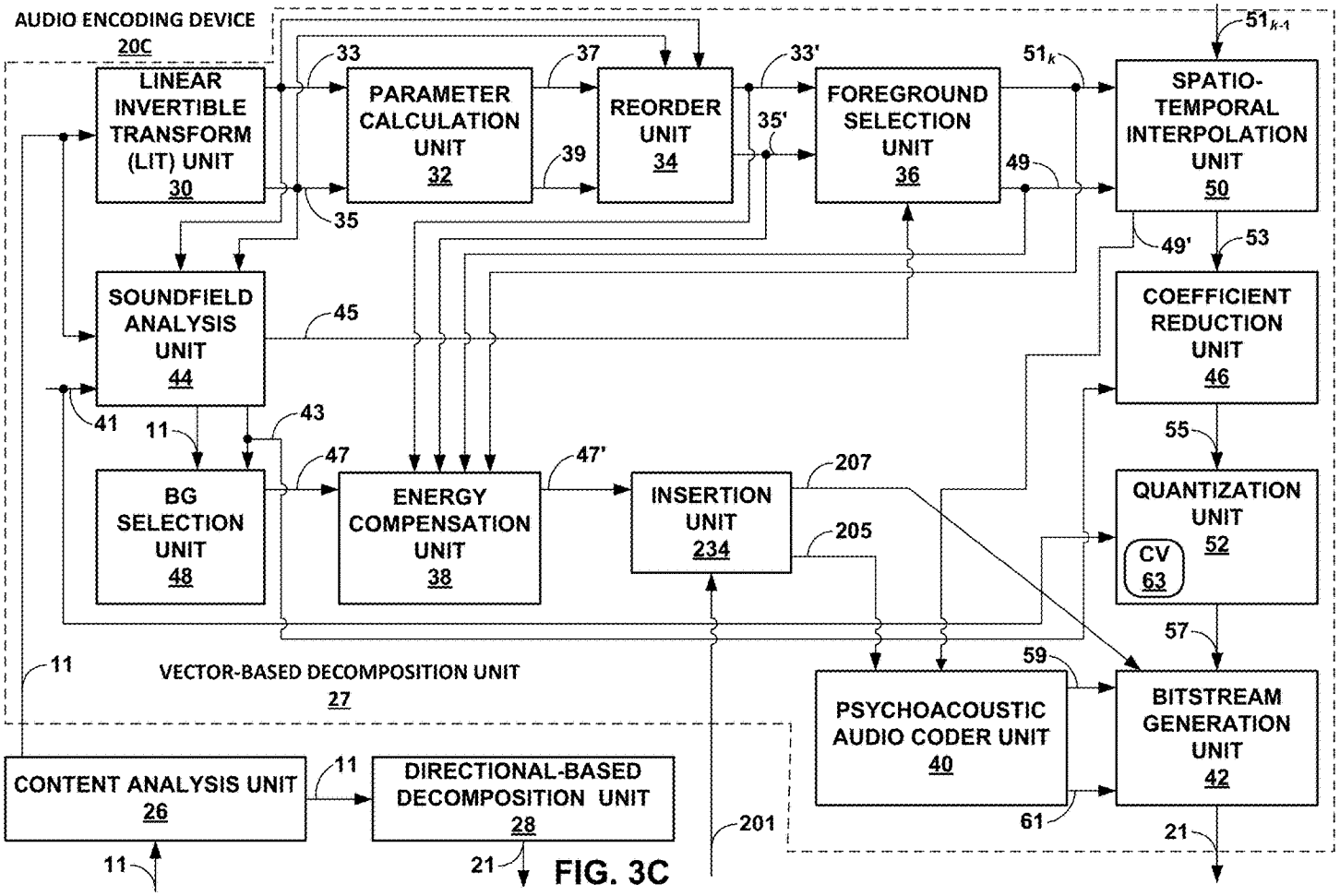

FIGS. 3A-3C are block diagrams illustrating, in more detail, examples of the audio encoding device 20 shown in the example of FIG. 2 that may perform various aspects of the techniques described in this disclosure. In the example of FIG. 3A, the audio encoding device 20A includes a content analysis unit 26, a vector-based decomposition unit 27 and a directional-based decomposition unit 28. Although described briefly below, more information regarding the audio encoding device 20A and the various aspects of compressing or otherwise encoding HOA coefficients is available in International Patent Application Publication No. WO 2014/194099, entitled "INTERPOLATION FOR DECOMPOSED REPRESENTATIONS OF A SOUND FIELD," and filed 29 May 2014.

The content analysis unit 26 represents a unit configured to analyze the content of the HOA coefficients 11 to identify whether the HOA coefficients 11 represent content generated from a live recording or an audio object. The content analysis unit 26 may determine whether the HOA coefficients 11 were generated from a recording of an actual soundfield or from an artificial audio object. In some instances, when the framed HOA coefficients 11 were generated from a recording, the content analysis unit 26 passes the HOA coefficients 11 to the vector-based decomposition unit 27. In some instances, when the framed HOA coefficients 11 were generated from a synthetic audio object, the content analysis unit 26 passes the HOA coefficients 11 to the directional-based synthesis unit 28. The directional-based synthesis unit 28 may represent a unit configured to perform a directional-based synthesis of the HOA coefficients 11 to generate a directional-based bitstream 21.

As shown in the example of FIG. 3A, the vector-based decomposition unit 27 may include a linear invertible transform (LIT) unit 30, a parameter calculation unit 32, a reorder unit 34, a foreground selection unit 36, an energy compensation unit 38, a psychoacoustic audio coder unit 40, a bitstream generation unit 42, a soundfield analysis unit 44, a coefficient reduction unit 46, a background (BG) selection unit 48, a spatio-temporal interpolation unit 50, a quantization unit 52 and an insertion unit 234.

The linear invertible transform (LIT) unit 30 receives the HOA coefficients 11 in the form of HOA channels, each channel representative of a block or frame of a coefficient associated with a given order, sub-order of the spherical basis functions (which may be denoted as HOA[k], where k may denote the current frame or block of samples). The matrix of HOA coefficients 11 may have dimensions D: $M\times(N+1)^2$.

The LIT unit 30 may represent a unit configured to perform a form of analysis referred to as singular value decomposition. While described with respect to SVD, the techniques described in this disclosure may be performed with respect to any similar transformation or decomposition that provides for sets of linearly uncorrelated, energy compacted output. Also, reference to "sets" in this disclosure is generally intended to refer to non-zero sets unless specifically stated to the contrary and is not intended to refer to the classical mathematical definition of sets that includes the so-called "empty set." An alternative transformation may comprise a principal component analysis, which is often referred to as "PCA." Depending on the context, PCA may be referred to by a number of different names, such as discrete Karhunen-Loeve transform, the Hotelling transform, proper orthogonal decomposition (POD), and eigenvalue decomposition (EVD) to name a few examples. Properties of such operations that are conducive to the underlying goal of compressing audio data are 'energy compaction' and 'decorrelation' of the multichannel audio data.

In any event, assuming the LIT unit 30 performs a singular value decomposition (which, again, may be referred to as "SVD") for purposes of example, the LIT unit 30 may transform the HOA coefficients 11 into two or more sets of transformed HOA coefficients. The "sets" of transformed HOA coefficients may include vectors of transformed HOA coefficients. In the example of FIG. 3A, the LIT unit 30 may perform the SVD with respect to the HOA coefficients 11 to generate a so-called V matrix, an S matrix, and a U matrix. SVD, in linear algebra, may represent a factorization of a y-by-z real or complex matrix X (where X may represent multi-channel audio data, such as the HOA coefficients 11) in the following form:

$$X=USV^*$$

U may represent a y-by-y real or complex unitary matrix, where the y columns of U are known as the left-singular vectors of the multi-channel audio data. S may represent a y-by-z rectangular diagonal matrix with non-negative real numbers on the diagonal, where the diagonal values of S are known as the singular values of the multi-channel audio data. V* (which may denote a conjugate transpose of V) may represent a z-by-z real or complex unitary matrix, where the z columns of V* are known as the right-singular vectors of the multi-channel audio data.

In some examples, the V* matrix in the SVD mathematical expression referenced above is denoted as the conjugate transpose of the V matrix to reflect that SVD may be applied to matrices comprising complex numbers. When applied to matrices comprising only real-numbers, the complex conjugate of the V matrix (or, in other words, the V* matrix) may be considered to be the transpose of the V matrix. Below it is assumed, for ease of illustration purposes, that the HOA coefficients 11 comprise real-numbers with the result that the V matrix is output through SVD rather than the V* matrix. Moreover, while denoted as the V matrix in this disclosure, reference to the V matrix should be understood to refer to the transpose of the V matrix where appropriate. While assumed to be the V matrix, the techniques may be applied in a similar fashion to HOA coefficients 11 having complex coefficients, where the output of the SVD is the V* matrix. Accordingly, the techniques should not be limited in this respect to only provide for application of SVD to generate a V matrix, but may include application of SVD to HOA coefficients 11 having complex components to generate a V* matrix.

In this way, the LIT unit 30 may perform SVD with respect to the HOA coefficients 11 to output US[k] vectors 33 (which may represent a combined version of the S vectors and the U vectors) having dimensions D: $M\times(N+1)^2$, and V[k] vectors 35 having dimensions D: $(N+1)^2\times(N+1)^2$. Individual vector elements in the US[k] matrix may also be termed $X_{PS}$ (k) while individual vectors of the V[k] matrix may also be termed v(k).

An analysis of the U, S and V matrices may reveal that the matrices carry or represent spatial and temporal characteristics of the underlying soundfield represented above by X. Each of the N vectors in U (of length M samples) may represent normalized separated audio signals as a function of time (for the time period represented by M samples), that are orthogonal to each other and that have been decoupled from any spatial characteristics (which may also be referred to as directional information). The spatial characteristics, representing spatial shape and position (r, theta, phi) may instead be represented by individual $i^{th}$ vectors, $v^{(i)}(k)$, in the V matrix (each of length $(N+1)^2$). The individual elements of each of $v^{(i)}(k)$ vectors may represent an HOA coefficient describing the shape (including width) and position of the soundfield for an associated audio object. Both the vectors in the U matrix and the V matrix are normalized such that their root-mean-square energies are equal to unity. The energy of the audio signals in U are thus represented by the diagonal elements in S. Multiplying U and S to form US[k] (with individual vector elements $X_{PS}(k)$), thus represent the audio signal with energies. The ability of the SVD decomposition to decouple the audio time-signals (in U), their energies (in S) and their spatial characteristics (in V) may support various aspects of the techniques described in this disclosure. Further, the model of synthesizing the underlying HOA[k] coefficients, X, by a vector multiplication of US[k] and V[k] gives rise to the term "vector-based decomposition," which is used throughout this document.

Although described as being performed directly with respect to the HOA coefficients 11, the LIT unit 30 may apply the linear invertible transform to derivatives of the HOA coefficients 11. For example, the LIT unit 30 may apply SVD with respect to a power spectral density matrix derived from the HOA coefficients 11. By performing SVD with respect to the power spectral density (PSD) of the HOA coefficients rather than the coefficients themselves, the LIT unit 30 may potentially reduce the computational complexity of performing the SVD in terms of one or more of processor cycles and storage space, while achieving the same source audio encoding efficiency as if the SVD were applied directly to the HOA coefficients.

The parameter calculation unit 32 represents a unit configured to calculate various parameters, such as a correlation parameter (R), directional properties parameters (θ, φ, r), and an energy property (e). Each of the parameters for the current frame may be denoted as R[k], θ[k], φ[k], r[k] and e[k]. The parameter calculation unit 32 may perform an energy analysis and/or correlation (or so-called cross-correlation) with respect to the US[k] vectors 33 to identify the parameters. The parameter calculation unit 32 may also determine the parameters for the previous frame, where the previous frame parameters may be denoted R[k−1], θ[k−1], φ[k−1], r[k−1] and e[k−1], based on the previous frame of US[k−1] vector and V[k−1] vectors. The parameter calculation unit 32 may output the current parameters 37 and the previous parameters 39 to reorder unit 34.

The parameters calculated by the parameter calculation unit 32 may be used by the reorder unit 34 to re-order the audio objects to represent their natural evaluation or continuity over time. The reorder unit 34 may compare each of the parameters 37 from the first US[k] vectors 33 turn-wise against each of the parameters 39 for the second US[k−1] vectors 33. The reorder unit 34 may reorder (using, as one example, a Hungarian algorithm) the various vectors within the US[k] matrix 33 and the V[k] matrix 35 based on the current parameters 37 and the previous parameters 39 to output a reordered US[k] matrix 33' (which may be denoted mathematically as $\overline{US}[k]$) and a reordered V[k] matrix 35' (which may be denoted mathematically as $\overline{V}[k]$) to a foreground sound (or predominant sound—PS) selection unit 36 ("foreground selection unit 36") and an energy compensation unit 38.

The soundfield analysis unit 44 may represent a unit configured to perform a soundfield analysis with respect to the HOA coefficients 11 so as to potentially achieve a target bitrate 41. The soundfield analysis unit 44 may, based on the analysis and/or on a received target bitrate 41, determine the total number of psychoacoustic coder instantiations (which may be a function of the total number of ambient or background channels ($BG_{TOT}$) and the number of foreground channels or, in other words, predominant channels. The total number of psychoacoustic coder instantiations can be denoted as numHOATransportChannels.

The soundfield analysis unit 44 may also determine, again to potentially achieve the target bitrate 41, the total number of foreground channels (nFG) 45, the minimum order of the background (or, in other words, ambient) soundfield ($N_{BG}$ or, alternatively, MinAmbHOAorder), the corresponding number of actual channels representative of the minimum order of background soundfield (nBGa=(MinAmbHOAorder+1)$^2$), and indices (i) of additional BG HOA channels to send (which may collectively be denoted as background channel information 43 in the example of FIG. 3A). The background channel information 42 may also be referred to as ambient channel information 43. Each of the channels that remains from numHOATransportChannels−nBGa, may either be an "additional background/ambient channel," an "active vector-based predominant channel," an "active directional based predominant signal" or "completely inactive." In one aspect, the channel types may be indicated with (e.g., as a "ChannelType") syntax element by two bits (e.g. 00: directional based signal; 01: vector-based predominant signal; 10: additional ambient signal; 11: inactive signal). The total number of background or ambient signals, nBGa, may be given by $(\text{MinAmbHOAorder}+1)^2+$ the number of times the index 10 (in the above example) appears as a channel type in the bitstream for that frame.

The soundfield analysis unit 44 may select the number of background (or, in other words, ambient) channels and the number of foreground (or, in other words, predominant) channels based on the target bitrate 41, selecting more background and/or foreground channels when the target bitrate 41 is relatively higher (e.g., when the target bitrate 41 equals or is greater than 512 Kbps). In one aspect, the numHOATransportChannels may be set to 8 while the MinAmbHOAorder may be set to 1 in the header section of the bitstream. In this scenario, at every frame, four channels may be dedicated to represent the background or ambient portion of the soundfield while the other 4 channels can, on a frame-by-frame basis, vary on the type of channel—e.g., either by being used as an additional background/ambient channel or a foreground/predominant channel. The foreground/predominant signals can be one of either vector-based or directional based signals, as described above.

In some instances, the total number of vector-based predominant signals for a frame may be given by the number of times the ChannelType index is 01 in the bitstream of that frame. In the above aspect, for every additional background/ambient channel (e.g., corresponding to a ChannelType of 10), corresponding information of which of the possible HOA coefficients (beyond the first four) may be represented in that channel. The information, for fourth order HOA content, may be an index to indicate the HOA coefficients 5-25. The first four ambient HOA coefficients 1-4 may be sent all the time when minAmbHOAorder is set to 1; hence the audio encoding device may only need to indicate one of the additional ambient HOA coefficient having an index of 5-25. The information could thus be sent using a 5 bits syntax element (for $4^{th}$ order content), which may be denoted as "CodedAmbCoeffIdx." In any event, the soundfield analysis unit 44 outputs the background channel information 43 and the HOA coefficients 11 to the background (BG) selection unit 36, the background channel information 43 to coefficient reduction unit 46 and the bitstream generation unit 42, and the nFG 45 to a foreground selection unit 36.

The background selection unit 48 may represent a unit configured to determine background or ambient HOA coefficients 47 based on the background channel information (e.g., the background soundfield ($N_{BG}$) and the number (nBGa) and the indices (i) of additional BG HOA channels to send). For example, when $N_{BG}$ equals one, the background selection unit 48 may select the HOA coefficients 11 for each sample of the audio frame having an order equal to or less than one. The background selection unit 48 may, in this example, then select the HOA coefficients 11 having an index identified by one of the indices (i) as additional BG HOA coefficients, where the nBGa is provided to the bitstream generation unit 42 to be specified in the bitstream 21 so as to enable the audio decoding device, such as the audio decoding device 24 shown in the example of FIGS. 2 and 4, to parse the background HOA coefficients 47 from the bitstream 21. The background selection unit 48 may then output the ambient HOA coefficients 47 to the energy compensation unit 38. The ambient HOA coefficients 47 may have dimensions D: $M\times[(N_{BG}+1)^2+\text{nBGa}]$. The ambient HOA coefficients 47 may also be referred to as "ambient HOA coefficients 47," where each of the ambient HOA coefficients 47 corresponds to a separate ambient HOA channel 47 to be encoded by the psychoacoustic audio coder unit 40.

The foreground selection unit 36 may represent a unit configured to select the reordered US[k] matrix 33' and the reordered V[k] matrix 35' that represent foreground or distinct components of the soundfield based on nFG 45 (which may represent a one or more indices identifying the foreground vectors). The foreground selection unit 36 may output nFG signals 49 (which may be denoted as a reordered $US[k]_{1,\ldots,nFG}$ 49, $FG_{1,\ldots,nfG}[k]$ 49, or $X_{PS}^{(1\ldots nFG)}(k)$ 49) to the psychoacoustic audio coder unit 40, where the nFG signals 49 may have dimensions D: M x nFG and each represent mono-audio objects. The foreground selection unit 36 may also output the reordered V[k] matrix 35' (or $v^{(1\ldots nFG)}(k)$ 35') corresponding to foreground components of the soundfield to the spatio-temporal interpolation unit 50, where a subset of the reordered V[k] matrix 35' corresponding to the foreground components may be denoted as foreground V[k] matrix $\mathbf{51}_k$ (which may be mathematically denoted as $\overline{V}_{1,\ldots,nFG}[k]$) having dimensions D: $(N+1)^2\times$ nFG.

The energy compensation unit 38 may represent a unit configured to perform energy compensation with respect to the ambient HOA coefficients 47 to compensate for energy loss due to removal of various ones of the HOA channels by the background selection unit 48. The energy compensation unit 38 may perform an energy analysis with respect to one or more of the reordered US[k] matrix 33', the reordered V[k] matrix 35', the nFG signals 49, the foreground V[k] vectors $\mathbf{51}_k$ and the ambient HOA coefficients 47 and then perform energy compensation based on the energy analysis to generate energy compensated ambient HOA coefficients 47'. The energy compensation unit 38 may output the energy compensated ambient HOA coefficients 47' to insertion unit 234.

The insertion unit 234 represents a unit configured to insert the separate audio channel 201 into the energy compensated ambient HOA coefficients 47' in order to generate the augmented ambient HOA coefficients 205 in accordance with various aspects of the techniques described in this disclosure.

As noted above, the insertion unit 234 may represent a unit configured insert a separate (from the perspective of being different audio content than that described by the HOA coefficients 11) audio channel into the energy compensated ambient HOA coefficients 47' and thereby generate the augmented ambient HOA coefficients 205. The insertion unit 234 may insert this separate audio channel 201 without increasing (or with only negligible impact on) the amount of bits allocated to represent the energy compensated ambient HOA coefficients 47'. In other words, the number of bits used to represent the energy compensated ambient HOA coefficients 47' may be approximately (if not exactly) the same as the number of bits used to represent the augmented HOA coefficients 205. The insertion unit 234 may select spatial locations in the soundfield where audio content is not usually present or of large importance to describing the soundfield and insert the separate audio channel 201 in these spatial locations, thereby replacing this aspect of soundfield with the separate audio channel 201. In some instances, these spatial locations may be the top and/or bottom of the soundfield.

This separate audio channel 201 may represent, in some examples, omni-directional audio content, which refers to audio content that has nearly no directional content, such as commentary by an announcer or sportscaster or any other overlay audio content (for advertisements, etc.). In some examples, this separate audio channel 201 may provide English commentary, dialog or other audio content separate from the soundfield represented by the HOA coefficients 11 so that an end-user may mute or otherwise adjust the volume of the commentary provided by the audio channel 201 separately from the volume of the audio channels rendered from the HOA coefficients 11. In some examples, the insertion unit 234 may insert two or more separate audio channels 201 into the energy compensated ambient HOA coefficients 47', where the two or more separate audio channels 201 may each provide commentary, dialog or other audio content in a different language. Likewise, the insertion unit 234 may, in some examples insert two or more separate audio channels 201 into the energy compensated ambient HOA coefficients 47', where the two or more separate audio channels 201 may each provide commentary, dialog or other audio content from a different sportscaster or other commentator.

While shown as inserting a single separate audio channel 201, the insertion unit 234 may insert any number of audio channels 201 into the energy compensated ambient HOA coefficients 47' to the extent portions of the energy compensated ambient HOA coefficients 47' allow for such audio channels 201 to be inserted. To illustrate, assume the order of the energy compensated ambient HOA coefficients 47' is one, meaning that there are four HOA channels (one for coefficients corresponding to the zeroth order, zeroth suborder basis function, one for coefficients corresponding to the first order, −1 suborder basis function, one for coefficients corresponding to the first order, 0 suborder basis function, and one for coefficients corresponding to the first order, +1 suborder basis function). Under this assumption the first order representation of the soundfield may provide for six spatial locations (one at the top of a sphere (which is the general shape of the soundfield), one at the bottom of the sphere, and four placed along the horizontal plane bisecting a sphere) at which to locate the separate audio channel 201.

In this first order representation, the insertion unit 234 inserts these audio channels 201 at the top and bottom of the sphere, given that many end-users do not have a 3D audio speaker setup sufficient to accurately playback audio at these top and bottom locations. For representations of higher order, additional locations are available and depending on target bitrates for the bitstream 21. The additional locations may become available for higher target bitrates that may provide for higher-order (meaning higher than first order) representations of the energy compensated ambient HOA coefficients 47'.

In any event, because this separate audio channel 201 does not have much in terms of a particular directionality but is omni-directional overlay audio content, the insertion unit 234 may insert this content in any spatial location of the soundfield described by the energy compensated ambient HOA coefficients 47' and need not, at least in this example, preserve the directionality of the soundfield. In this way, the insertion unit 234 may insert the separate audio channel 201 into the soundfield described by the energy compensated ambient HOA coefficients 47' without increasing (or with only negligible impact) on the amount of bits allocated to represent the energy compensated ambient HOA coefficients 47'.

To insert the separate audio channel 201, the insertion unit 234 may transform the energy compensated ambient HOA coefficients 47' from the spherical harmonic domain to the spatial domain (using, as one example, a dense T-design matrix). The insertion unit 234 may be configured to insert the separate audio channel 201 into a particular spatial location (such as the bottom spatial location) within the transformed energy compensated ambient HOA coefficients 47' to generate augmented transformed ambient HOA coefficients. The insertion unit 234 may then transform the augmented transformed ambient HOA coefficients back from the spatial domain to the spherical harmonic domain to generate the augmented ambient HOA coefficients 205. In this way, the insertion unit 234 may insert the separate audio channel 201 into the energy compensated ambient HOA coefficients 47' to generate the augmented ambient HOA coefficients 205. The insertion unit 234 may then output the augmented ambient HOA coefficients 205 to the psychoacoustic audio coder unit 40.

The spatio-temporal interpolation unit 50 may represent a unit configured to receive the foreground V[k] vectors $\mathbf{51}_k$ for the $k^{th}$ frame and the foreground V[k−1] vectors $\mathbf{51}_{k-1}$ for the previous frame (hence the k−1 notation) and perform spatio-temporal interpolation to generate interpolated foreground V[k] vectors. The spatio-temporal interpolation unit 50 may recombine the nFG signals 49 with the foreground V[k] vectors $\mathbf{51}_k$ to recover reordered foreground HOA coefficients. The spatio-temporal interpolation unit 50 may then divide the reordered foreground HOA coefficients by the interpolated V[k] vectors to generate interpolated nFG signals 49'. The spatio-temporal interpolation unit 50 may also output the foreground V[k] vectors $\mathbf{51}_k$ that were used to generate the interpolated foreground V[k] vectors so that an audio decoding device, such as the audio decoding device 24, may generate the interpolated foreground V[k] vectors and thereby recover the foreground V[k] vectors $\mathbf{51}_k$. The foreground V[k] vectors $\mathbf{51}_k$ used to generate the interpolated foreground V[k] vectors are denoted as the remaining foreground V[k] vectors 53. In order to ensure that the same V[k] and V[k−1] are used at the encoder and decoder (to create the interpolated vectors V[k]) quantized/dequantized versions of the vectors may be used at the encoder and decoder. The spatio-temporal interpolation unit 50 may output the interpolated nFG signals 49' to the psychoacoustic audio coder unit 46 and the interpolated foreground V[k] vectors $\mathbf{51}_k$ to the coefficient reduction unit 46.

The coefficient reduction unit 46 may represent a unit configured to perform coefficient reduction with respect to the remaining foreground V[k] vectors 53 based on the background channel information 43 to output reduced foreground V[k] vectors 55 to the quantization unit 52. The reduced foreground V[k] vectors 55 may have dimensions D: $[(N+1)^2-(N_{BG}+1)^2-BG_{TOT}]\times nFG$. The coefficient reduction unit 46 may, in this respect, represent a unit configured to reduce the number of coefficients in the remaining foreground V[k] vectors 53. In other words, coefficient reduction unit 46 may represent a unit configured to eliminate the coefficients in the foreground V[k] vectors (that form the remaining foreground V[k] vectors 53) having little to no directional information.

In some examples, the coefficients of the distinct or, in other words, foreground V[k] vectors corresponding to a first and zero order basis functions (which may be denoted as $N_{BG}$) provide little directional information and therefore can be removed from the foreground V-vectors (through a process that may be referred to as "coefficient reduction"). In these examples, greater flexibility may be provided to not only identify the coefficients that correspond $N_{BG}$ but to identify additional HOA channels (which may be denoted by the variable TotalOfAddAmbHOAChan) from the set of $[(N_{BG}+1)^2+1, (N+1)^2]$.

The quantization unit 52 may represent a unit configured to perform any form of quantization to compress the reduced foreground V[k] vectors 55 to generate coded foreground V[k] vectors 57, outputting the coded foreground V[k] vectors 57 to the bitstream generation unit 42. In operation, the quantization unit 52 may represent a unit configured to compress a spatial component of the soundfield, i.e., one or more of the reduced foreground V[k] vectors 55 in this example. The quantization unit 52 may perform any one of the following 12 quantization modes, as indicated by a quantization mode syntax element denoted "NbitsQ":

| NbitsQ value | Type of Quantization Mode |
|---|---|
| 0-3: | Reserved |
| 4: | Vector Quantization |
| 5: | Scalar Quantization without Huffman Coding |
| 6: | 6-bit Scalar Quantization with Huffman Coding |
| 7: | 7-bit Scalar Quantization with Huffman Coding |
| 8: | 8-bit Scalar Quantization with Huffman Coding |
| . . . | . . . |
| 16: | 16-bit Scalar Quantization with Huffman Coding |

The quantization unit 52 may also perform predicted versions of any of the foregoing types of quantization modes, where a difference is determined between an element of (or a weight when vector quantization is performed) of the V-vector of a previous frame and the element (or weight when vector quantization is performed) of the V-vector of a current frame is determined. The quantization unit 52 may then quantize the difference between the elements or weights of the current frame and previous frame rather than the value of the element of the V-vector of the current frame itself.

The quantization unit 52 may perform multiple forms of quantization with respect to each of the reduced foreground V[k] vectors 55 to obtain multiple coded versions of the reduced foreground V[k] vectors 55. The quantization unit 52 may select the one of the coded versions of the reduced foreground V[k] vectors 55 as the coded foreground V[k] vector 57. The quantization unit 52 may, in other words, select one of the non-predicted vector-quantized V-vector, predicted vector-quantized V-vector, the non-Huffman-coded scalar-quantized V-vector, and the Huffman-coded scalar-quantized V-vector to use as the output switched-quantized V-vector based on any combination of the criteria discussed in this disclosure.

In some examples, the quantization unit 52 may select a quantization mode from a set of quantization modes that includes a vector quantization mode and one or more scalar quantization modes, and quantize an input V-vector based on (or according to) the selected mode. The quantization unit 52 may then provide the selected one of the non-predicted vector-quantized V-vector (e.g., in terms of weight values or bits indicative thereof), predicted vector-quantized V-vector (e.g., in terms of error values or bits indicative thereof), the non-Huffman-coded scalar-quantized V-vector and the Huffman-coded scalar-quantized V-vector to the bitstream generation unit 52 as the coded foreground V[k] vectors 57. The quantization unit 52 may also provide the syntax elements indicative of the quantization mode (e.g., the NbitsQ syntax element) and any other syntax elements used to dequantize or otherwise reconstruct the V-vector.

The psychoacoustic audio coder unit 40 included within the audio encoding device 20A may represent multiple instances of a psychoacoustic audio coder, each of which is used to encode a different audio object or HOA channel of each of the augmented ambient HOA coefficients 205 and the interpolated nFG signals 49' to generate encoded ambient HOA coefficients 59 and encoded nFG signals 61. The psychoacoustic audio coder unit 40 may output the encoded ambient HOA coefficients 59 and the encoded nFG signals 61 to the bitstream generation unit 42.

The bitstream generation unit 42 included within the audio encoding device 20A represents a unit that formats data to conform to a known format (which may refer to a format known by a decoding device), thereby generating the vector-based bitstream 21. The bitstream 21 may, in other words, represent encoded audio data, having been encoded in the manner described above. The bitstream generation unit 42 may represent a multiplexer in some examples, which may receive the coded foreground V[k] vectors 57, the encoded ambient HOA coefficients 59, the encoded nFG signals 61 and the background channel information 43. The bitstream generation unit 42 may then generate a bitstream 21 based on the coded foreground V[k] vectors 57, the encoded ambient HOA coefficients 59, the encoded nFG signals 61 and the background channel information 43. In this way, the bitstream generation unit 42 may thereby specify the vectors 57 in the bitstream 21 to obtain the bitstream 21 as described below in more detail with respect to the example of FIG. 7. The bitstream 21 may include a primary or main bitstream and one or more side channel bitstreams.

Although not shown in the example of FIG. 3A, the audio encoding device 20A may also include a bitstream output unit that switches the bitstream output from the audio encoding device 20A (e.g., between the directional-based bitstream 21 and the vector-based bitstream 21) based on whether a current frame is to be encoded using the directional-based synthesis or the vector-based synthesis. The bitstream output unit may perform the switch based on the syntax element output by the content analysis unit 26 indicating whether a directional-based synthesis was performed (as a result of detecting that the HOA coefficients 11 were generated from a synthetic audio object) or a vector-based synthesis was performed (as a result of detecting that the HOA coefficients were recorded). The bitstream output unit may specify the correct header syntax to indicate the switch or current encoding used for the current frame along with the respective one of the bitstreams 21.

Moreover, as noted above, the soundfield analysis unit 44 may identify $BG_{TOT}$ ambient HOA coefficients 47, which may change on a frame-by-frame basis (although at times $BG_{TOT}$ may remain constant or the same across two or more adjacent (in time) frames). The change in $BG_{TOT}$ may result in changes to the coefficients expressed in the reduced foreground V[k] vectors 55. The change in $BG_{TOT}$ may result in background HOA coefficients (which may also be referred to as "ambient HOA coefficients") that change on a frame-by-frame basis (although, again, at times $BG_{TOT}$ may remain constant or the same across two or more adjacent (in time) frames). The changes often result in a change of energy for the aspects of the sound field represented by the addition or removal of the additional ambient HOA coefficients and the corresponding removal of coefficients from or addition of coefficients to the reduced foreground V[k] vectors 55.

As a result, the soundfield analysis unit 44 may further determine when the ambient HOA coefficients change from frame to frame and generate a flag or other syntax element indicative of the change to the ambient HOA coefficient in terms of being used to represent the ambient components of the sound field (where the change may also be referred to as a "transition" of the ambient HOA coefficient or as a "transition" of the ambient HOA coefficient). In particular, the coefficient reduction unit 46 may generate the flag (which may be denoted as an AmbCoeffTransition flag or an AmbCoeffIdxTransition flag), providing the flag to the bitstream generation unit 42 so that the flag may be included in the bitstream 21 (possibly as part of side channel information).

The coefficient reduction unit 46 may, in addition to specifying the ambient coefficient transition flag, also modify how the reduced foreground V[k] vectors 55 are generated. In one example, upon determining that one of the ambient HOA ambient coefficients is in transition during the current frame, the coefficient reduction unit 46 may specify, a vector coefficient (which may also be referred to as a "vector element" or "element") for each of the V-vectors of the reduced foreground V[k] vectors 55 that corresponds to the ambient HOA coefficient in transition. Again, the ambient HOA coefficient in transition may add or remove from the $BG_{TOT}$ total number of background coefficients. Therefore, the resulting change in the total number of background coefficients affects whether the ambient HOA coefficient is included or not included in the bitstream, and whether the corresponding element of the V-vectors are included for the V-vectors specified in the bitstream in the second and third configuration modes described above. More information regarding how the coefficient reduction unit 46 may specify the reduced foreground V[k] vectors 55 to overcome the changes in energy is provided in U.S. application Ser. No. 14/594,533, entitled "TRANSITIONING OF AMBIENT HIGHER_ORDER AMBISONIC COEFFICIENTS," filed Jan. 12, 2015.

In the example of FIG. 3B, the audio encoding device 20B is similar to the audio encoding device 20A shown in the example of FIG. 3A, except that the insertion unit 234 of the audio encoding device 20B also receives the V[k] vectors 35 and performs an analysis of the V[k] vectors 35 to identify the spatial location at which to insert separate audio channel 201 into the energy compensated ambient HOA coefficients 47'. In some examples, rather than use the entire V[k] vectors 35, the insertion unit 234 may receive the reduced V[k] vectors 55 and perform the analysis of the reduced V[k] vectors 55 in order to identify the spatial location at which the separate audio channel 201 is to be inserted. In this way, the insertion unit 234 may analyze a portion of a vector-based decomposition of the higher-order ambisonic representation of the soundfield to identify the spatial location within the soundfield, and insert the audio channel at the identified spatial location.

In the example of FIG. 3C, the audio encoding device 20C is similar to the audio encoding devices 20A and 20B shown in the examples of FIGS. 3A and 3B, except that the insertion unit 234 performs an analysis of the soundfield to identify the spatial location at which to insert the separate audio channel 201, e.g., similar to that described above with respect to audio encoding device 20B. In some examples, the insertion unit 234 may identify locations at which spatial masking (where a loud sound at one location masks any sounds occurring at an adjacent location or location proximate to the loud sound location) or simultaneous masking (where a sound is made inaudible by a noise or unwanted sound of the same duration as the original sound) is occurring. At these locations where spatial, simultaneous or other forms of masking are occurring, the insertion unit 234 may insert the separate audio channel 201. Because these forms of masking may occur in different locations in the soundfield, the insertion unit 234 may generate insertion information 207 identifying the spatial location at which the separate audio channel 201 was inserted. The insertion unit 234 may provide the insertion information 207 to the bitstream generation unit 42, which may specify the insertion information 207 in the bitstream 21.

In some examples, the insertion unit 234 may obtain a V-vector identifying the spatial location at which the separate audio channel 201 has been inserted (e.g., by way of the analysis described above with respect to the example of FIG. 3B). The insertion unit 234 may provide this V-vector to the bitstream generation unit 42 as the insertion information 207 so that the bitstream generation unit 42 may specify the V-vector associated with the separate audio channel 201 in the bitstream 21. In other words, the spatial location specified by the insertion information 207 may comprise a V-vector. Unlike the V-vectors that is specified in the bitstream 21 for the foreground (or, in other words, the predominant) audio objects, the insertion information 207 comprising the V-vector may specify the V-vector for the augmented ambient HOA coefficients. In this way, the audio decoding device 24 may not need to perform an analysis similar to the audio encoding device 20C to identify the location of the separate audio channel 201 in the augmented ambient HOA coefficients.

When masking is not present in the soundfield, the insertion unit 234 may analyze the soundfield to identify any "holes" (which may refer to absences of relative salient information) in the soundfield in which the separate audio channel 201 may be inserted, which may be similar to the analysis performed by the audio encoding device 20B described above. The insertion unit 234 may perform nearly any form of analysis to identify these holes and then insert the separate audio channel 201 into these holes. The insertion unit 234 may, given that these holes may move within the soundfield, generate the insertion information 207 and provide this insertion information 207 to the bitstream generation unit 42, which may specify this insertion information 207 in the bitstream 21.

Although not shown in the examples of FIG. 3A-3C, the bitstream generation unit 42 may insert additional metadata or other information describing the separate audio channel 201. This metadata may identify the corresponding audio channel 201 in terms of the content, language, commentator name or other data that may describe the type, language, name of a commentator or other characteristics of the separate audio channel 201.

In other words, the insertion unit 234 may project the energy compensated ambient HOA coefficients 47' (which may be denoted as $SH_{ORIG}(n, m, t)$, where n denotes the order of the corresponding spherical basis function, m denotes the sub-order of the corresponding spherical basis function, and t denotes time) into 3D space, e.g., by multiplying with a T-design matrix, to generate transformed energy compensated ambient HOA coefficients 47' (which may be denoted as pressure $P(\theta,\phi)$).

Figure 5A:
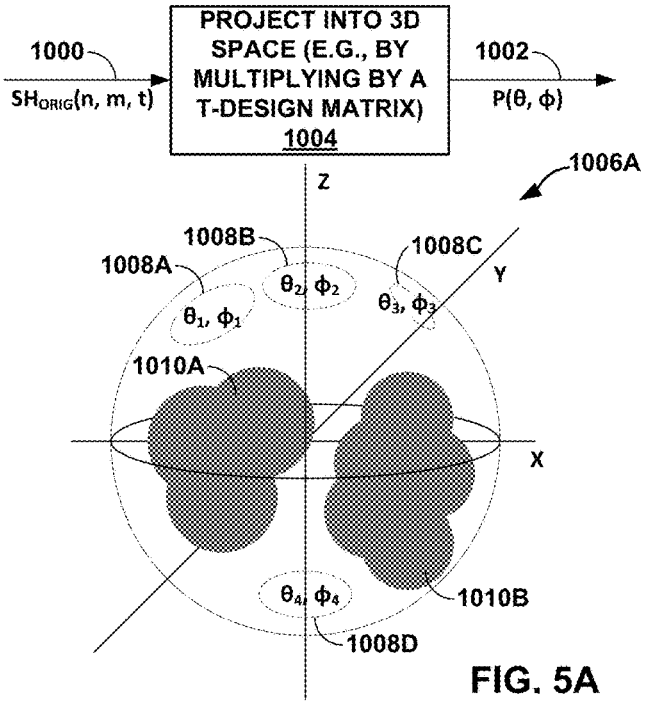
FIGS. 5A-5C are diagrams illustrating exemplary operation of an insertion unit of the audio encoding device in performing various aspects of the insertion techniques described in this disclosure.
Figure 5B:
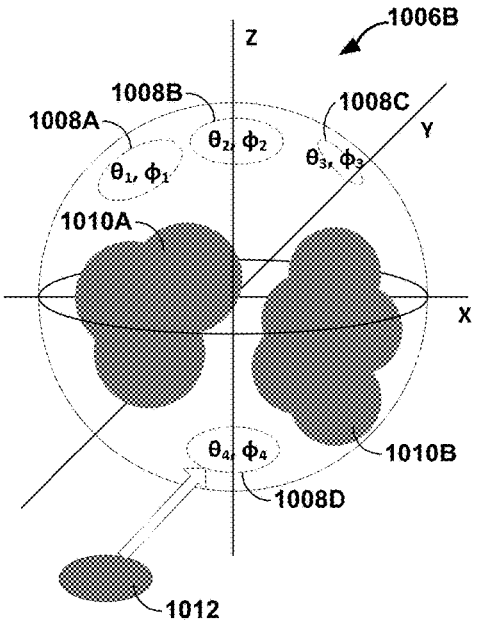
Figure 5C:
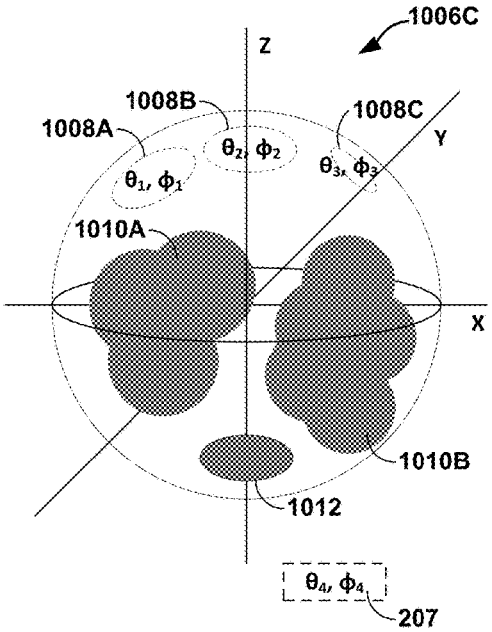

FIGS. 5A-5C are diagrams illustrating exemplary operations of the insertion unit 234 in performing various aspects of the insertion techniques described in this disclosure. The insertion unit 234 may receive $SH_{ORIG}(n, m, t)$ 1000 and project these $SH_{ORIG}(n, m, t)$ 1000 into 3D space to generate P(θ,ϕ) 1002 (1004), which may resemble graph 1006 shown in the example of FIGS. 5A-5C.

As shown in the graph 1006A of FIG. 5A, the insertion unit 234 may analyze the soundfield shown in graph 1006 to identify four areas/holes 1008A-1008D (having respective locations identified by $\theta_1, \phi_1|\theta_2, \phi_2|\theta_3, \phi_3|\theta_4, \phi_4$) given areas 1010A and 1010B of acoustic activity. The insertion unit 234 may then position up to four audio objects into this space by performing the following:

1) Calculate the $SH_i$ for each of these audio objects $a_i(t)$ as follows:

2)

$$SH_i(n, m, t) = a_i(t)Y_n^m(\theta_i, \phi_i);$$

$$SH_{NEW}(n, m, t) = SH_{ORIG}(n, m, t) + \sum_{i=1}^{4} SH_i(n, m, t); \text{ and}$$

3) Send (as shown in the example of FIG. 3C), the insertion information 207 as side channel information, which may specify the set of four $\theta_i$, $\phi_i$.

In some examples, the side channel information may specify the insertion information 207 to aid decoding devices 24A-24C in performing SVD to extract the four added audio objects. That is, the insertion unit 234 may insert the audio objects into the soundfield, $$\text{e.g., } SH_{NEW}(n, m, t) = SH_{ORIG}(n, m, t) + \sum_{i=1}^{4} SH_i(n, m, t)$$

and send via the side channel information the set of four $\theta_i$, $\phi_i$ where the objects were inserted. Then the decoding device 24B or 24C may perform an SVD (or any other form of source separation, such as those described above including eigenvalue decomposition (EVD), principal component analysis (PCA), KLT transform, and the like) to extract the audio objects, which may be aided by also receiving the set of four $\theta_i$, $\phi_i$ identifying where the added audio channels were inserted.

In the example of FIG. 5B, the insertion unit 234 may obtain a separate audio channel 1012 and perform an augmentation of the soundfield represented by graph 1006B, inserting the separate audio channel 1012 into area 1008D. The result of the augmentation is shown in the example of FIG. 5C. The augmented HOA representation of the soundfield is represented by graph 1006C, where after the augmentation, the HOA represented is augmented to include the separate audio channel 1012 at the spatial location $\theta_4$, $\phi_4$. The spatial location $\theta_4$, $\phi_4$ may represent one example of location information 207.

The insertion unit 234 may also, as noted above, create holes in the soundfield and add the audio channels in the manner described above. The insertion unit 234 may perform the following:

1) Do a positional analysis of ambient HOA coefficients;

2) Determine, based on the positional analysis, which positions or areas can be "emptied" without creating perceptual effects (these can be, as one example, 'low energy' areas which are measured by neighboring high energy areas—or the bottom—which is often not rendered (because of the lack of loudspeakers, as an example, in the bottom or lower hemisphere)); and 3) Zero out these areas to create the holes 1008A-1008D.

Figure 6:
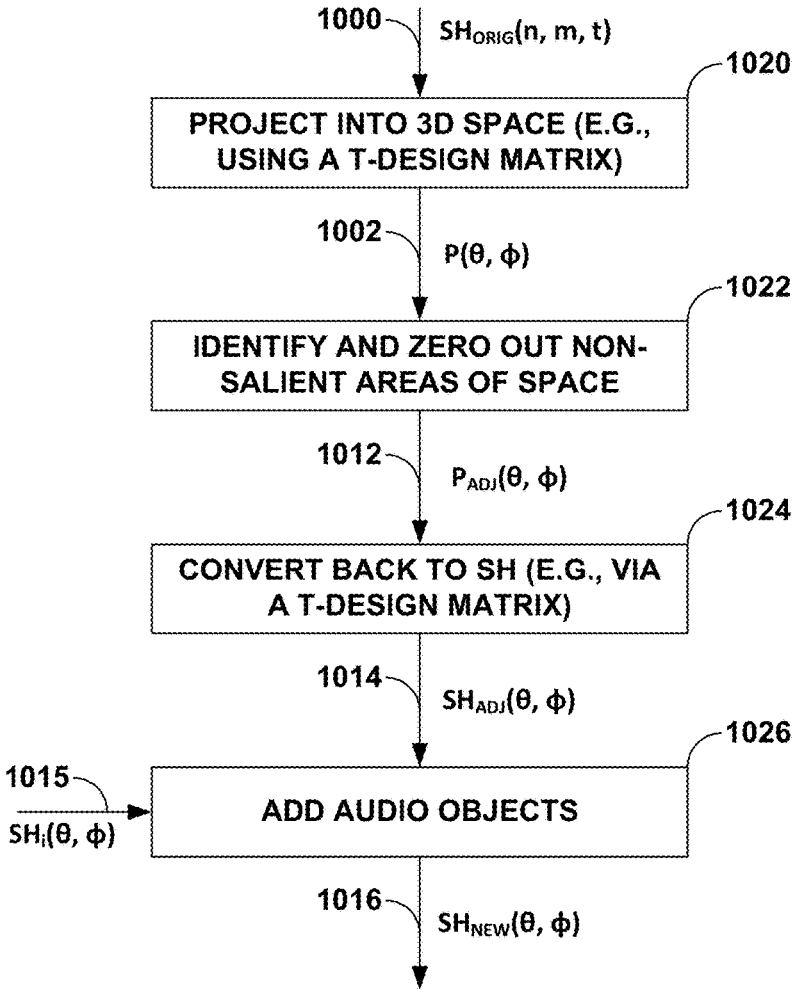
FIG. 6 is a flowchart illustrating exemplary operation of an insertion unit of the audio encoding device in performing various aspects of the area creation and insertion techniques described in this disclosure.

The following process is shown in FIG. 6, which is a flowchart illustrating exemplary operation of this aspect of the area creation and insertion process. The insertion unit 234 may receive the $SH_{ORIG}(n, m, t)$ 1000 and project the $SH_{ORIG}(n, m, t)$ 1000 into 3D space (1020) to generate the P(θ,ϕ) 1002. The insertion unit 234 may then perform the positional analysis to identify and zero out non-salient areas 1008A-1008D of space and thereby generate $P_{ADJ}(\theta,\phi)$ 1012 (1022). The insertion unit 234 may then convert the $P_{ADJ}(\theta,\phi)$ 1012 back to the spherical harmonic domain (e.g., via a T-design matrix) to generate $SH_{ADJ}(n, m, t)$ 1014 (1024). The insertion unit 234 may then add the audio objects denoted as $SH_i(n, m, t)$ 1015 to the $SH_{ADJ}(n, m, t)$ 1014 to generate $SH_{NEW}(n, m, t)$ per the mathematical formula noted above) (1026).

In this way, various aspects of the techniques enable the audio encoding devices 20A-20C ("audio encoding devices 20") to obtain an audio channel separate from a higher-order ambisonic representation of a soundfield, and insert the audio channel at a spatial location within the soundfield such that the audio channel is able to be extracted from the soundfield.

In these and other examples, the spatial location is located at a bottom of the soundfield.

In these and other examples, the spatial location is located at a top of the soundfield.

In these and other examples, the audio encoding devices 20 are configured to analyze the soundfield to identify the spatial location within the soundfield affected by spatial masking, and insert the audio channel at the identified spatial location.

In these and other examples, the higher-order ambisonic representation of the soundfield comprises a plurality of higher-order ambisonic coefficients descriptive of the soundfield, and the audio encoding devices 20 are configured to transform the plurality of higher-order ambisonic coefficients from a spherical harmonic domain to a spatial domain so as to obtain a spatial domain representation of the soundfield, and insert the audio channel at the spatial location within the spatial domain representation of the soundfield.

In these and other examples, the higher-order ambisonic representation of the soundfield comprises a plurality of higher-order ambisonic coefficients descriptive of the soundfield, and the audio encoding devices 20 are configured to transform the plurality of higher-order ambisonic coefficients from a spherical harmonic domain to a spatial domain so as to obtain a spatial domain representation of the soundfield, insert the audio channel at the spatial location within the spatial domain representation of the soundfield to obtain an augmented spatial domain representation of the soundfield, and transform the augmented spatial domain representation of the soundfield from the spatial domain back to the spherical harmonic domain to obtain an augmented higher-order ambisonic representation of the soundfield.

In these and other examples, the audio encoding devices 20 are further configured to specify, in a bitstream that includes the higher-order ambisonic representation of the soundfield, the spatial location to which the audio channel was inserted.

In these and other examples, the audio encoding devices 20 are configured to specify, in a bitstream that includes the higher-order ambisonic representation of the soundfield, information descriptive of the audio channel.

In these and other examples, the information descriptive of the audio channel comprises information identifying a sportscaster.

In these and other examples, the information descriptive of the audio channel comprises information identifying a language in which commentary present in the audio channel is spoken.

In these and other examples, the information descriptive of the audio channel comprises information identifying a type of content present in the audio channel.

In these and other examples, the audio channel comprises an audio channel from a sportscaster.

In these and other examples, the audio channel comprises an audio channel obtained by a non-broadcaster.

In these and other examples, the audio channel comprises a non-English audio channel providing commentary in a non-English language.

In these and other examples, the audio channel comprises an English audio channel providing commentary in an English language.

In these and other examples, the higher-order ambisonic representation of the soundfield comprises a plurality of higher-order ambisonic coefficients descriptive of an ambient component of the soundfield.

In these and other examples, the audio encoding devices 830 are configured to analyze a portion of a vector-based decomposition of the higher-order ambisonic representation of the soundfield to identify the spatial location within the soundfield, and insert the audio channel at the identified spatial location.

In these and other examples, the device comprises a handset. In these and other examples, the device comprises a tablet. In these and other examples, the device comprises a smart phone.

Figure 4A:
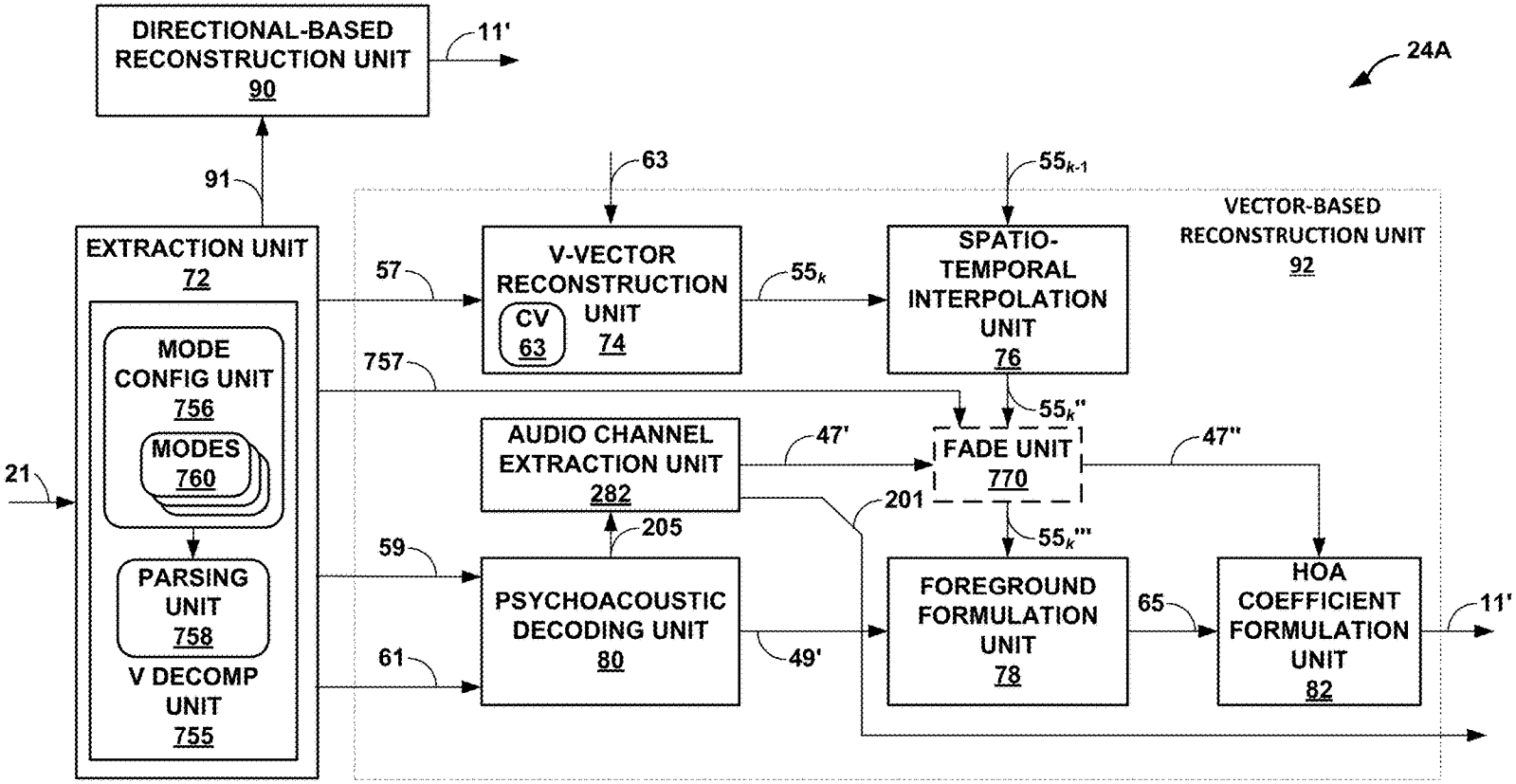
FIGS. 4A-4C are block diagrams illustrating various examples of the audio decoding device shown in FIG. 2 that may perform various aspects of the techniques described in this disclosure.
Figure 4B:
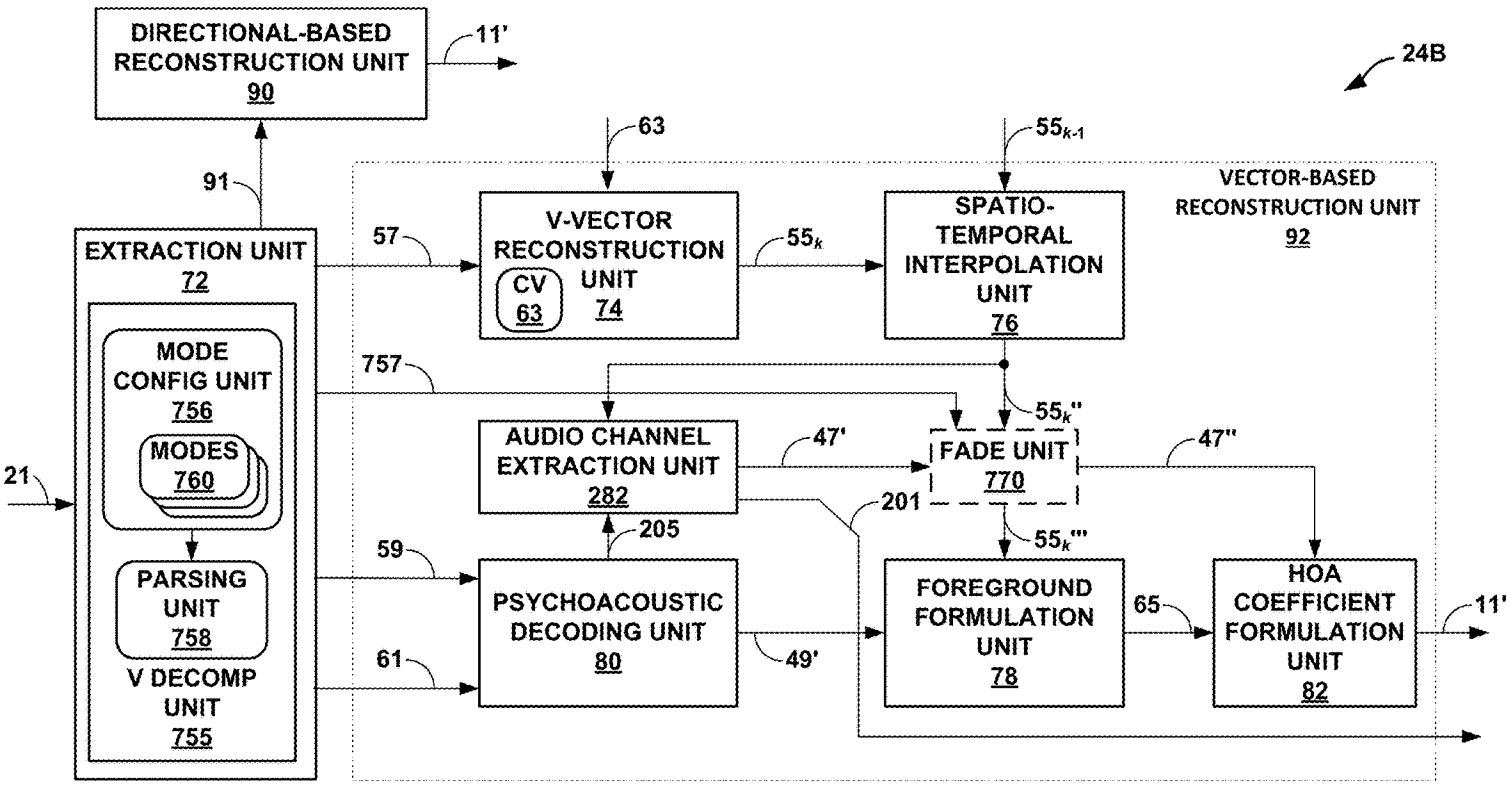
Figure 4C:
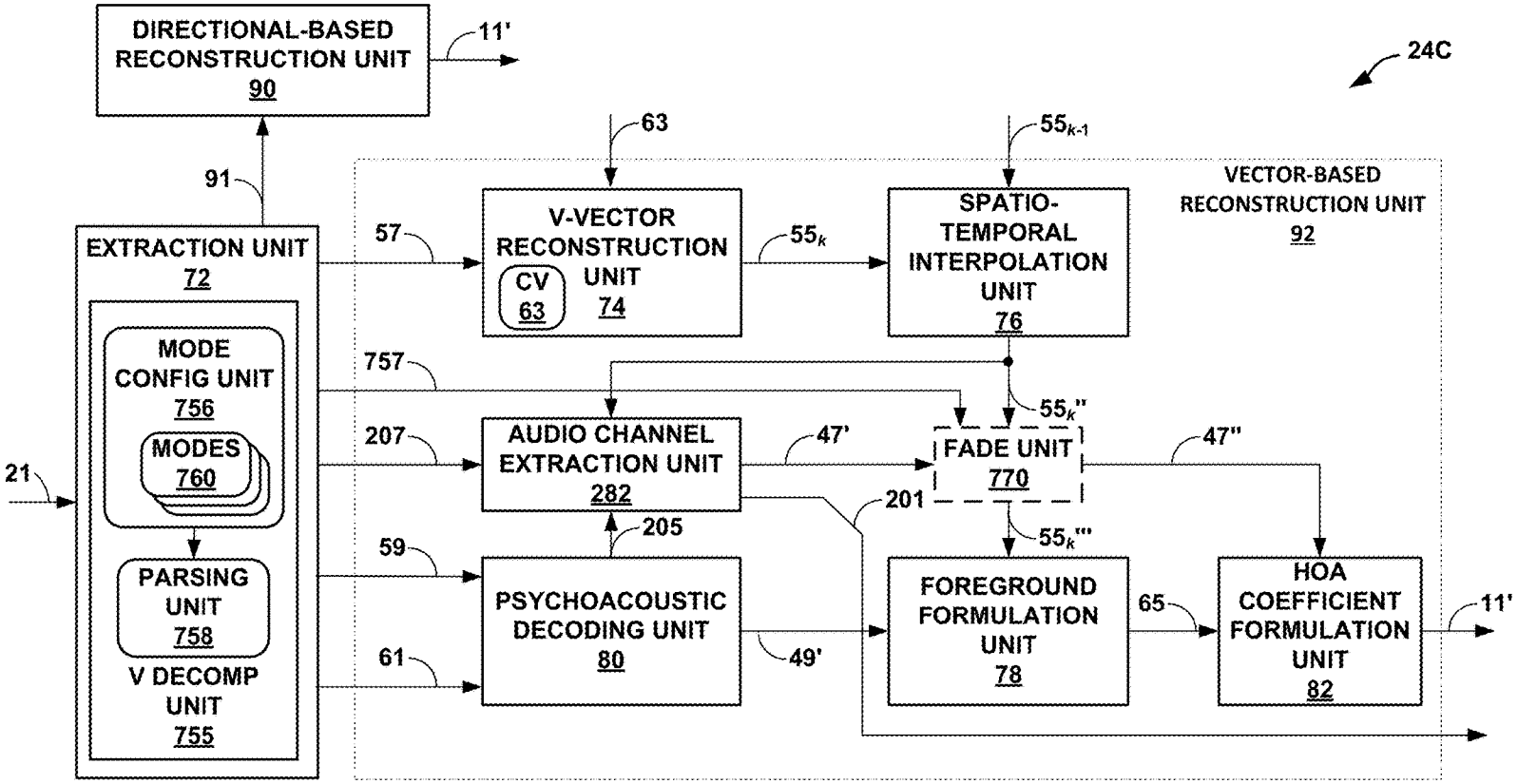

FIGS. 4A-4C are block diagrams illustrating different examples of the audio decoding device 24 of FIG. 2 in more detail. As shown in the example of FIG. 4A, the audio decoding device 24A may include an extraction unit 72, a directionality-based reconstruction unit 90 and a vector-based reconstruction unit 92. Although described below, more information regarding the audio decoding device 24 and the various aspects of decompressing or otherwise decoding HOA coefficients is available in International Patent Application Publication No. WO 2014/194099, entitled "INTERPOLATION FOR DECOMPOSED REPRESENTATIONS OF A SOUND FIELD," and filed 29 May 2014.

In FIG. 4A, the extraction unit 72 may represent a unit configured to receive the bitstream 21 and extract the various encoded versions (e.g., a directional-based encoded version or a vector-based encoded version) of the HOA coefficients 11. The extraction unit 72 may determine from a syntax element indicative of whether the HOA coefficients 11 were encoded via the various direction-based or vector-based versions. When a directional-based encoding was performed, the extraction unit 72 may extract the directional-based version of the HOA coefficients 11 and the syntax elements associated with the encoded version (which is denoted as directional-based information 91 in the example of FIG. 4A), passing the directional based information 91 to the directional-based reconstruction unit 90. The directional-based reconstruction unit 90 may represent a unit configured to reconstruct the HOA coefficients in the form of HOA coefficients 11' based on the directional-based information 91.

When the syntax element indicates that the HOA coefficients 11 were encoded using a vector-based synthesis, the extraction unit 72 may extract the coded foreground V[k] vectors 57 (which may include coded weights 57 and/or indices of code vectors 63 or scalar quantized V-vectors), the encoded ambient HOA coefficients 59 and the corresponding audio objects 61 (which may also be referred to as the encoded nFG signals 61). The audio objects 61 each correspond to one of the vectors 57. The extraction unit 72 may pass the coded foreground V[k] vectors 57 to the V-vector reconstruction unit 74 and the encoded ambient HOA coefficients 59 along with the encoded nFG signals 61 to the psychoacoustic decoding unit 80.

The V-vector reconstruction unit 74 may represent a unit configured to reconstruct the V-vectors from the encoded foreground V[k] vectors 57. The V-vector reconstruction unit 74 may operate in a manner reciprocal to that of the quantization unit 52.

The psychoacoustic decoding unit 80 may operate in a manner reciprocal to the psychoacoustic audio coder unit 40 shown in the example of FIG. 3A so as to decode the encoded ambient HOA coefficients 59 and the encoded nFG signals 61 and thereby generate energy compensated ambient HOA coefficients 47' and the interpolated nFG signals 49' (which may also be referred to as interpolated nFG audio objects 49'). The psychoacoustic decoding unit 80 may pass the energy compensated ambient HOA coefficients 47' to an audio channel extraction unit 282 and the nFG signals 49' to the foreground formulation unit 78.

The audio channel extraction unit 282 receives the augmented ambient HOA coefficients 205 and extracts the separate audio channel 201 from the implicitly known (meaning, in this context, configured) spatial location (e.g., the bottom location or the top location). The audio channel extraction unit 282 may, to extract the separate audio channel 201, transform the augmented ambient HOA coefficients 205 from the spherical harmonic domain to the spatial domain to generate transformed augmented ambient HOA coefficients 205. The audio channel extraction unit 282 may extract the separate audio channel 201 from the implicitly known spatial location of the transformed augmented ambient HOA coefficients 205, generating transformed energy compensated ambient HOA coefficients 47'. The audio channel extraction unit 282 may transform the transformed energy compensated ambient HOA coefficients 47' back from the spatial domain to the spherical harmonic domain. The audio channel extraction unit 282 may forward the energy compensated ambient HOA coefficients 47' to the fade unit 770.

The spatio-temporal interpolation unit 76 may operate in a manner similar to that described above with respect to the spatio-temporal interpolation unit 50. The spatio-temporal interpolation unit 76 may receive the reduced foreground V[k] vectors $\mathbf{55}_k$ and perform the spatio-temporal interpolation with respect to the foreground V[k] vectors $\mathbf{55}_k$ and the reduced foreground V[k−1] vectors $\mathbf{55}_{k-1}$ to generate interpolated foreground V[k] vectors $\mathbf{55}_k$". The spatio-temporal interpolation unit 76 may forward the interpolated foreground V[k] vectors $\mathbf{55}_k$" to the fade unit 770.

The extraction unit 72 may also output a signal 757 indicative of when one of the ambient HOA coefficients is in transition to fade unit 770, which may then determine which of the $SHC_{BG}$ 47' (where the $SHC_{BG}$ 47' may also be denoted as "ambient HOA channels 47" or "ambient HOA coefficients 47') and the elements of the interpolated foreground V[k] vectors $\mathbf{55}_k$" are to be either faded-in or faded-out. In some examples, the fade unit 770 may operate opposite with respect to each of the ambient HOA coefficients 47' and the elements of the interpolated foreground V[k] vectors $\mathbf{55}_k''$. That is, the fade unit 770 may perform a fade-in or fade-out, or both a fade-in or fade-out with respect to a corresponding one of the ambient HOA coefficients 47', while performing a fade-in or fade-out or both a fade-in and a fade-out, with respect to the corresponding one of the elements of the interpolated foreground V[k] vectors $\mathbf{55}_k''$. The fade unit 770 may output adjusted ambient HOA coefficients 47" to the HOA coefficient formulation unit 82 and adjusted foreground V[k] vectors $\mathbf{55}_k'''$ to the foreground formulation unit 78. In this respect, the fade unit 770 represents a unit configured to perform a fade operation with respect to various aspects of the HOA coefficients or derivatives thereof, e.g., in the form of the ambient HOA coefficients 47' and the elements of the interpolated foreground V[k] vectors $\mathbf{55}_k''$.

The foreground formulation unit 78 may represent a unit configured to perform matrix multiplication with respect to the adjusted foreground V[k] vectors $\mathbf{55}_k'''$ and the interpolated nFG signals 49' to generate the foreground HOA coefficients 65. In this respect, the foreground formulation unit 78 may combine the audio objects 49' (which is another way by which to denote the interpolated nFG signals 49') with the vectors $\mathbf{55}_k'''$ to reconstruct the foreground or, in other words, predominant aspects of the HOA coefficients 11'. The foreground formulation unit 78 may perform a matrix multiplication of the interpolated nFG signals 49' by the adjusted foreground V[k] vectors $\mathbf{55}_k'''$.

The HOA coefficient formulation unit 82 may represent a unit configured to combine the foreground HOA coefficients 65 to the adjusted ambient HOA coefficients 47" so as to obtain the HOA coefficients 11'. The prime notation reflects that the HOA coefficients 11' may be similar to but not the same as the HOA coefficients 11. The differences between the HOA coefficients 11 and 11' may result from loss due to transmission over a lossy transmission medium, quantization or other lossy operations.

In the example of FIG. 4B, the audio channel extraction unit 282 of the audio decoding device 24B may receive both the augmented ambient HOA coefficients 205 and the interpolated foreground V[k] vectors $\mathbf{55}_k''$. In this example, the audio channel extraction unit 282 may analyze the interpolated foreground V[k] vectors $\mathbf{55}_k''$ to identify the spatial location at which the separate audio channel 201 was inserted. The audio channel extraction unit 282 may, in this example, extract the separate audio channel 201 from the augmented ambient HOA coefficients 205. Given that, for the preceding two examples involving an implicit spatial location and an analysis of a portion of a vector-based decomposition of the HOA coefficients 11, no additional information is specified in the bitstream 21 to identify the spatial location at which the separate audio channel 201 was inserted, the preceding two examples may promote more efficient coding of the HOA coefficients 11 that includes the separate audio channel 201 in comparison to the following example involving the insertion information 207.

In the example of FIG. 4C, the extraction unit 282 of the audio decoding device 24C may receive the insertion information 207 after having been parsed from the bitstream 21 by the extraction unit 72. Based on this insertion information 207, the audio channel extraction unit 282 may identify the spatial location at which the separate audio channel 201 was inserted. The audio channel extraction unit 282 may extract this separate audio channel 201 from the spatial location in the manner described above. While the inclusion of the insertion information 207 in the bitstream 21 may not result in the most compact bitstream in comparison to the bitstreams 21 that do not include this insertion information 207, the inclusion of this information 207 may enable the audio channel extraction unit 282 to more efficiently (in terms of processing cycles) identify the spatial location while also allowing for the flexibility to insert this in locations that are not implicitly known. As noted above, the insertion information 207 may include a V-vector rather than azimuth and elevation angles. The V-vector may, again as noted above, identify the spatial location of the separate audio channel 205 in the augmented ambient HOA coefficients.

Figure 7:
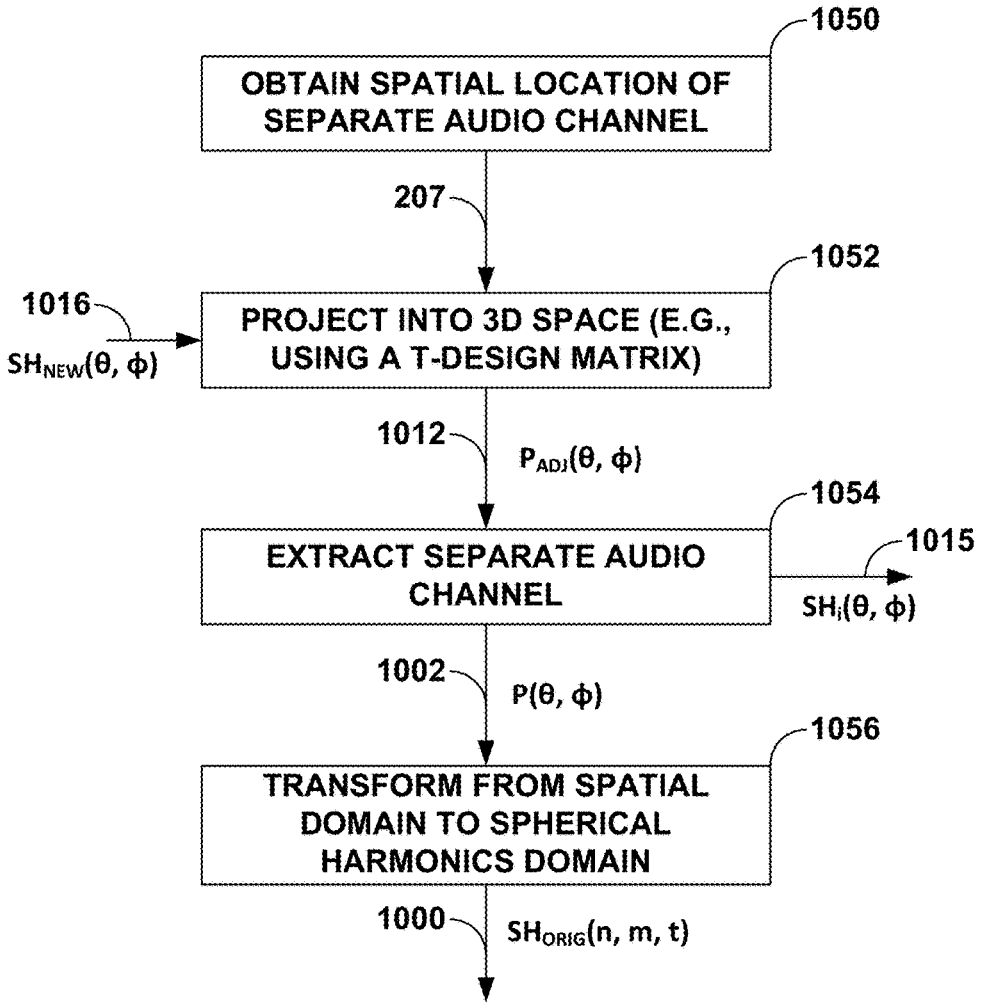
FIG. 7 is a flowchart illustrating exemplary operation of an audio channel extraction unit of the audio decoding device in performing various aspects of the audio channel extraction techniques described in this disclosure.

FIG. 7 is a flowchart illustrating exemplary operation of the audio decoding device of FIG. 2 in performing various aspects of the techniques described in this disclosure. The audio channel extraction unit 282 may obtain the special location 207 of the separate audio channel 201 in the augmented ambient HOA coefficients 205 via one or more of the ways described above with respect to the examples of FIGS. 4A-4C (1050). The audio channel extraction unit 282 of the audio decoding device 20 may receive the augmented ambient HOA coefficients 205, which may be denoted as $SH_{NEW}(\theta,\phi)$ 1016. The audio channel extraction unit 282 may transform the augmented ambient HOA coefficients 205 from the spherical harmonic domain to the spatial domain by projecting the augmented ambient HOA coefficients 205 into 3D space (1052). The result of transforming the augmented ambient HOA coefficients 205 is to generate transformed augmented ambient HOA coefficients 205, which may be denoted as $P_{ADJ}(\theta,\phi)$ 1012.

The audio channel extraction unit 282 may extract the separate audio channel 201 from the spatial location 207 of the transformed augmented ambient HOA coefficients 205 (1054), generating transformed energy compensated ambient HOA coefficients 47'(denoted as $P(\theta,\phi)$ (1002) in the example of FIG. 7). The audio channel extraction unit 282 may pass the additional audio channel 207 to the audio renderers 22. The additional audio channel 207 may also be denoted as $SH_i(\theta,\phi)$ 1015. The audio channel extraction unit 282 may transform the transformed energy compensated ambient HOA coefficients 47' back from the spatial domain to the spherical harmonic domain (1056), outputting the original energy compensated ambient HOA coefficients 47'. The energy compensated ambient HOA coefficients 47' may also be denoted as $SH_{ORIG}(n, m, t)$ 1000.

Figure 8A:
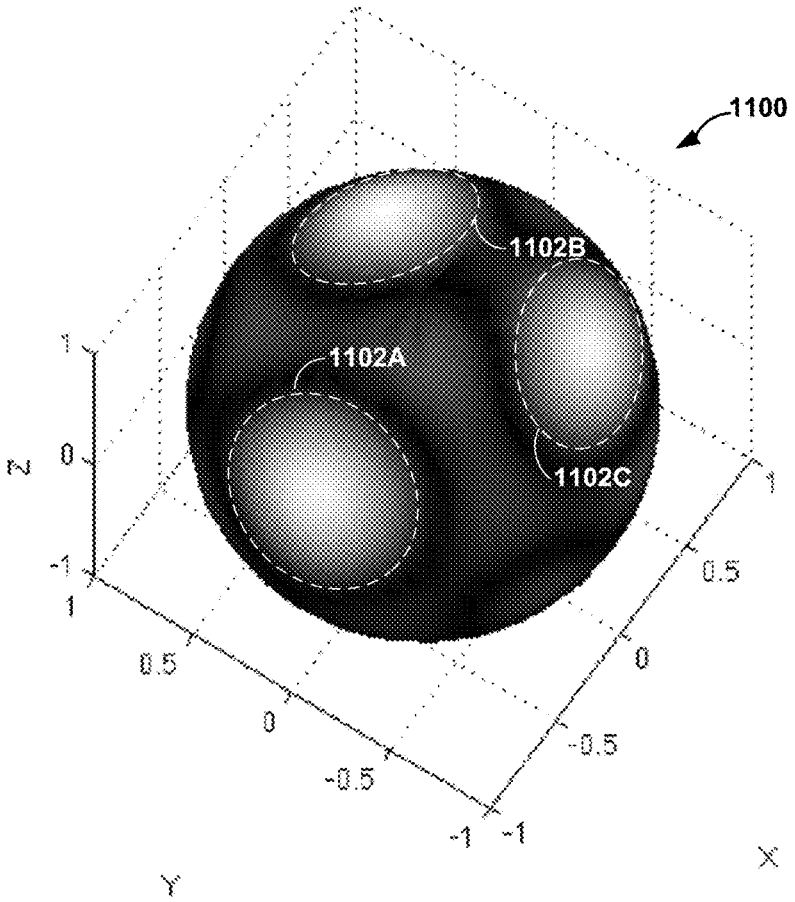
FIGS. 8A-8C are diagrams illustrating a soundfield to which an audio object may be inserted in accordance with the techniques described in this disclosure.
Figure 8B:
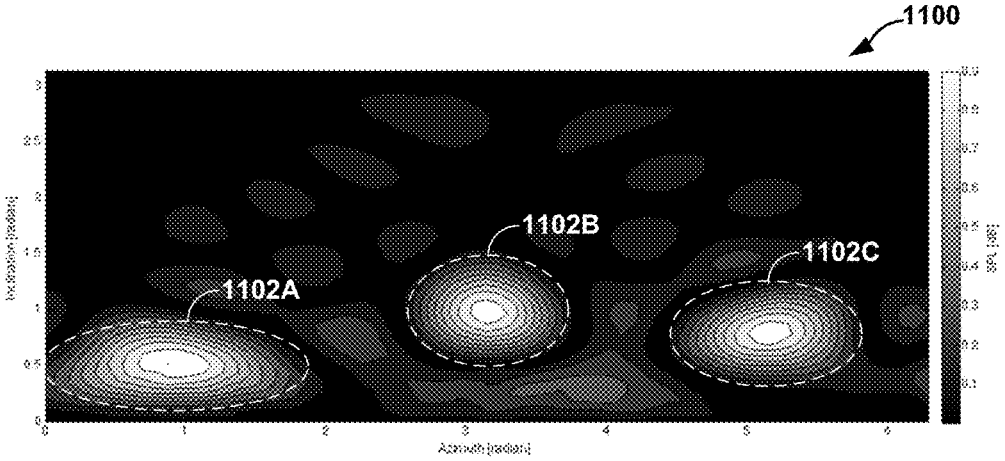
Figure 8C:
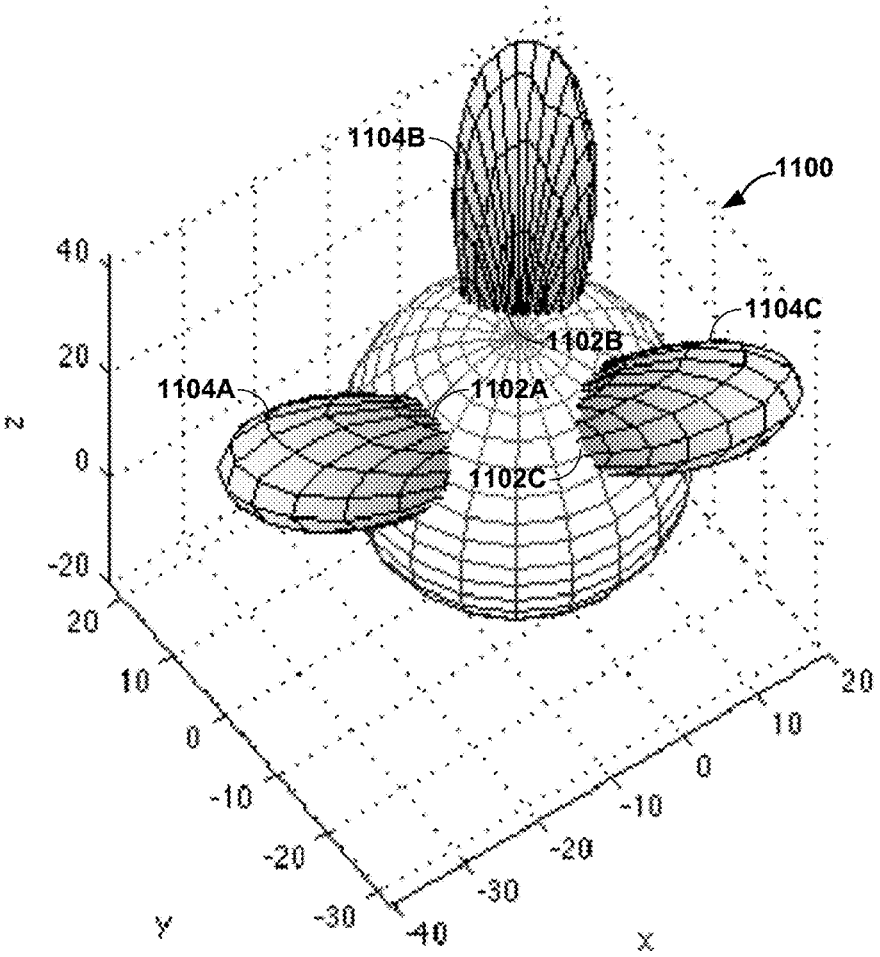

FIGS. 8A-8C are diagrams illustrating a soundfield 1100 to which an audio object may be inserted in accordance with the techniques described in this disclosure. The example of FIG. 8A illustrates the soundfield 1100 in three dimensions with the white coloring indicating a higher decibel (dB) level, the darker black areas indicating a relatively lower dB level and the varying shades of gray indicating increasing areas of pressure as the shade of gray decreases towards white. In other words, the soundfield 1100 shown in the example of FIG. 8A represents HOA coefficients representative of the soundfield 1100 projected onto a sphere at an assumed sweet spot. The light/white areas may denote areas where the pressure of the soundfield 1100 is higher, while the dark/black areas denote areas where the pressure of the soundfield 1100 is relatively lower. The example of FIG. 8B shows the top half of the same soundfield 1100 in two-dimensions.

An analysis of the soundfield 1100 by the insertion unit 234 may identify three salient or predominant audio areas 1102A-1102C at azimuth, elevation angles of [45, 30], [180, 60], and [300, 45]. The insertion unit 234 may identify that one or more of the three salient or predominant audio areas 1102A-1102C are masked or can otherwise be zeroed out.

The insertion unit 234 may insert a separate audio channel into one of these areas 1102A-1102C or into another area identified as having little to no salient audio information (e.g., an area of complete or near complete blackness) in the manner described above.

To illustrate, the insertion unit 234 may analyze soundfield 1100 and identify salient audio area 1102C as being masked by salient audio area 1102B. The insertion unit 234 may transform the energy compensated augmented HOA coefficients 47' from the spherical harmonics domain to the spatial domain. Although not shown in the example of FIGS. 3A-3B, the insertion unit 234 may perform the analysis and other operations described herein with respect to the ambient HOA coefficients 47 rather than the energy compensated ambient HOA coefficients 47'.

In any event, the insertion unit 234 may zero out or otherwise remove the salient audio area 1102C and insert the separate audio channel 201 at the location of the audio area 1102C. The insertion unit 234 may obtain the augmented ambient HOA coefficients 205 after performing the insertion. After obtaining the augmented ambient HOA coefficients 205, the insertion unit 234 may transform the augmented ambient HOA coefficients 205 from the spatial domain to the spherical harmonics domain. The insertion unit 205 may, in some examples, perform a vector-based analysis (e.g., an SVD, EVD, PCA, KLT, etc.) of the augmented ambient HOA coefficients 205 to identify a V-vector associated with the separate audio channel 205. The insertion unit 234 may provide the V-vector to the bitstream generation unit 42 as, at least a part, of the insertion information 207. The bitstream generation unit 42 may specify the insertion information 207 comprising the V-vector in the bitstream 42.

Alternatively, the soundfield 1100 may represent a rendering of the soundfield 1100 from the augmented ambient HOA coefficients 205. Considering the representation of the soundfield 1100 represents a rendering of the augmented ambient HOA coefficients 205, the salient audio objects 1102A-1102C may each represent a separate audio channel 201 that has been inserted into energy compensated ambient HOA coefficients 47'.

The example of FIG. 8C provides another three-dimensional view of the soundfield 1100 including the three salient audio areas 1102A-1102C along with a depiction of the corresponding V-vectors 1104A-1104C. The V-vectors 1104A-1104C each identify the direction, shape, width and volume of the salient audio areas 1102A-1102C for a duration of time (e.g., a frame) of the HOA coefficients 11. In effect, the V-vectors 1104A-1104C may each represent a spatio-temporal pocket of salient audio information. One or more of these pockets may be zeroed out to create a spatio-temporal pocket of non-salient audio information, which can be filled over the duration of time with the separate audio channel 201.

From the perspective of the audio decoding device 24, the audio channel extraction unit 282 may receive the augmented ambient HOA coefficients 205 and any accompanying insertion information 207 and perform a reciprocal process to extract the separate audio channel 201. To illustrate, the audio channel extraction unit 282 may transform the augmented ambient HOA coefficients 205 from the spherical harmonic domain to the spatial domain. The audio channel extraction unit 282 may then extract the separate audio channel 205 from an implicitly configured location (e.g., the top or bottom of the soundfield represented by the augmented ambient HOA coefficients 205), an explicitly derived location (e.g., by performing a vector-based analysis of the augmented ambient HOA coefficients 205), or through a signaled location as specified by, at least in part, the insertion information 207.

When the insertion information 207 comprises a V-vector, the audio channel extraction unit 282 may utilize the V-vector to identify the spatial location (e.g., which may specify the above noted spatio-temporal pocket) to which the separate audio channel 201 was inserted. In some instances, the V-vector may correspond to one of the salient audio area 1102A-1102C that has been zeroed out and used instead to specify the separate audio channel 201. The audio channel extraction unit 282 may output the separate audio channel 201 to be rendered by one of audio renderers 22. In some examples, the audio channel extraction unit 282 outputs the separate audio channel 201 without providing the V-vector. As a result, the separate audio channel 201 may not be rendered utilizing the corresponding V-vector.

Moreover, the audio channel extraction unit 282 does not utilize the V-vector corresponding to the separate audio channel 201 to formulate an HOA representation of the separate audio channel 201. Given that the separate audio channel 201 represents omni-directional audio content, the V-vector corresponding to the separate audio channel 201 does not accurately reflect the actual location, shape and width of the separate audio channel 201. Instead, the V-vector corresponding to the separate audio channel 201 identifying the location, shape and width of where the separate audio channel 201 has been inserted into the soundfield represented by the augmented ambient HOA coefficient 205, but is not utilized to reformulate the HOA representation of the separate audio channel 201 or render the separate audio channel 201. The audio playback system 16 may separately render the separate audio channel 201 to generate speaker feed 203, which the audio playback system 16 mixes into the speaker feeds 25 rendered from the reformulated HOA coefficients 11' using mixer 8.

In this way, various aspects of the techniques may enable the audio decoding device 24A-24C ("audio decoding devices 24") to obtain an augmented higher-order ambisonic representation of a soundfield that includes an audio channel separate from the soundfield, and extract an audio channel from a spatial location within the augmented higher-order ambisonic representation of the soundfield.

In these and other examples, the spatial location is located at a bottom of the soundfield.

In these and other examples, the spatial location is located at a top of the soundfield.

In these and other examples, the audio decoding devices 24 are configured to perform a vector-based analysis of the soundfield to identify the spatial location within the soundfield, and extract the audio channel from the identified spatial location.

In these and other examples, the augmented higher-order ambisonic representation of the soundfield comprises a plurality of higher-order ambisonic coefficients descriptive of the soundfield, and the audio decoding devices are configured to transform the plurality of higher-order ambisonic coefficients from a spherical harmonic domain to a spatial domain so as to obtain an augmented spatial domain representation of the soundfield, and extract the audio channel from the spatial location within the augmented spatial domain representation of the soundfield.

In these and other examples, the augmented higher-order ambisonic representation of the soundfield comprises a plurality of higher-order ambisonic coefficients descriptive of the soundfield, and the audio decoding devices 880 are configured to transform the plurality of higher-order ambisonic coefficients from a spherical harmonic domain to a spatial domain so as to obtain an augmented spatial domain representation of the soundfield, extract the audio channel from the spatial location within the augmented spatial domain representation of the soundfield to obtain a spatial domain representation of the soundfield, and transform the spatial domain representation of the soundfield from the spatial domain back to the spherical harmonic domain to obtain a higher-order ambisonic representation of the soundfield.

In these and other examples, the audio decoding devices 24 are further configured to determine, from a bitstream that includes the augmented higher-order ambisonic representation of the soundfield, the spatial location to which the audio channel was inserted.

In these and other examples, the audio decoding devices 24 are further configured to determine, from a bitstream that includes the augmented higher-order ambisonic representation of the soundfield, information descriptive of the audio channel.

In these and other examples, the information descriptive of the audio channel comprises information identifying a sportscaster.

In these and other examples, the information descriptive of the audio channel comprises information identifying a language in which commentary present in the audio channel is spoken.

In these and other examples, the information descriptive of the audio channel comprises information identifying a type of content present in the audio channel.

In these and other examples, the audio channel comprises an audio channel from a sportscaster.

In these and other examples, the audio channel comprises an audio channel obtained by a non-broadcaster.

In these and other examples, the audio channel comprises a non-English audio channel providing commentary in a non-English language.

In these and other examples, the audio channel comprises an English audio channel providing commentary in an English language.

In these and other examples, the higher-order ambisonic representation of the soundfield comprises a plurality of higher-order ambisonic coefficients descriptive of an ambient component of the soundfield.

In these and other examples, the device comprises a handset.

In these and other examples, the device comprises a tablet.

In these and other examples, the device comprises a smart phone.

The foregoing techniques may be performed with respect to any number of different contexts and audio ecosystems. A number of example contexts are described below, although the techniques should be limited to the example contexts. One example audio ecosystem may include audio content, movie studios, music studios, gaming audio studios, channel based audio content, coding engines, game audio systems, game audio coding/rendering engines, and delivery systems.

The movie studios, the music studios, and the gaming audio studios may receive audio content. In some examples, the audio content may represent the output of an acquisition. The movie studios may output channel based audio content (e.g., in 2.0, 5.1, and 7.1) such as by using a digital audio workstation (DAW). The music studios may output channel based audio content (e.g., in 2.0, and 5.1) such as by using a DAW. In either case, the coding engines may receive and encode the channel based audio content based one or more codecs (e.g., AAC, AC3, Dolby True HD, Dolby Digital Plus, and DTS Master Audio) for output by the delivery systems. The gaming audio studios may output one or more game audio stems, such as by using a DAW. The game audio coding/rendering engines may code and or render the audio stems into channel based audio content for output by the delivery systems. Another example context in which the techniques may be performed comprises an audio ecosystem that may include broadcast recording audio objects, professional audio systems, consumer on-device capture, HOA audio format, on-device rendering, consumer audio, TV, and accessories, and car audio systems.

The broadcast recording audio objects, the professional audio systems, and the consumer on-device capture may all code their output using HOA audio format. In this way, the audio content may be coded using the HOA audio format into a single representation that may be played back using the on-device rendering, the consumer audio, TV, and accessories, and the car audio systems. In other words, the single representation of the audio content may be played back at a generic audio playback system (i.e., as opposed to requiring a particular configuration such as 5.1, 7.1, etc.), such as audio playback system 16.

Other examples of context in which the techniques may be performed include an audio ecosystem that may include acquisition elements, and playback elements. The acquisition elements may include wired and/or wireless acquisition devices (e.g., Eigen microphones), on-device surround sound capture, and mobile devices (e.g., smartphones and tablets). In some examples, wired and/or wireless acquisition devices may be coupled to mobile device via wired and/or wireless communication channel(s).

In accordance with one or more techniques of this disclosure, the mobile device may be used to acquire a soundfield. For instance, the mobile device may acquire a soundfield via the wired and/or wireless acquisition devices and/or the on-device surround sound capture (e.g., a plurality of microphones integrated into the mobile device). The mobile device may then code the acquired soundfield into the HOA coefficients for playback by one or more of the playback elements. For instance, a user of the mobile device may record (acquire a soundfield of) a live event (e.g., a meeting, a conference, a play, a concert, etc.), and code the recording into HOA coefficients.

The mobile device may also utilize one or more of the playback elements to playback the HOA coded soundfield. For instance, the mobile device may decode the HOA coded soundfield and output a signal to one or more of the playback elements that causes the one or more of the playback elements to recreate the soundfield. As one example, the mobile device may utilize the wireless and/or wireless communication channels to output the signal to one or more speakers (e.g., speaker arrays, sound bars, etc.). As another example, the mobile device may utilize docking solutions to output the signal to one or more docking stations and/or one or more docked speakers (e.g., sound systems in smart cars and/or homes). As another example, the mobile device may utilize headphone rendering to output the signal to a set of headphones, e.g., to create realistic binaural sound.

In some examples, a particular mobile device may both acquire a 3D soundfield and playback the same 3D soundfield at a later time. In some examples, the mobile device may acquire a 3D soundfield, encode the 3D soundfield into HOA, and transmit the encoded 3D soundfield to one or more other devices (e.g., other mobile devices and/or other non-mobile devices) for playback.

Yet another context in which the techniques may be performed includes an audio ecosystem that may include audio content, game studios, coded audio content, rendering engines, and delivery systems. In some examples, the game studios may include one or more DAWs which may support editing of HOA signals. For instance, the one or more DAWs may include HOA plugins and/or tools which may be configured to operate with (e.g., work with) one or more game audio systems. In some examples, the game studios may output new stem formats that support HOA. In any case, the game studios may output coded audio content to the rendering engines which may render a soundfield for playback by the delivery systems.

The techniques may also be performed with respect to exemplary audio acquisition devices. For example, the techniques may be performed with respect to an Eigen microphone which may include a plurality of microphones that are collectively configured to record a 3D soundfield. In some examples, the plurality of microphones of Eigen microphone may be located on the surface of a substantially spherical ball with a radius of approximately 4 cm. In some examples, the audio encoding device 20A may be integrated into the Eigen microphone so as to output a bitstream 21 directly from the microphone.

Another exemplary audio acquisition context may include a production truck which may be configured to receive a signal from one or more microphones, such as one or more Eigen microphones. The production truck may also include an audio encoder, such as audio encoder 20 of FIG. 2.

The mobile device may also, in some instances, include a plurality of microphones that are collectively configured to record a 3D soundfield. In other words, the plurality of microphone may have X, Y, Z diversity. In some examples, the mobile device may include a microphone which may be rotated to provide X, Y, Z diversity with respect to one or more other microphones of the mobile device. The mobile device may also include an audio encoder, such as audio encoder 20 of FIG. 2.

A ruggedized video capture device may further be configured to record a 3D soundfield. In some examples, the ruggedized video capture device may be attached to a helmet of a user engaged in an activity. For instance, the ruggedized video capture device may be attached to a helmet of a user whitewater rafting. In this way, the ruggedized video capture device may capture a 3D soundfield that represents the action all around the user (e.g., water crashing behind the user, another rafter speaking in front of the user, etc. . . . ).

The techniques may also be performed with respect to an accessory enhanced mobile device, which may be configured to record a 3D soundfield. In some examples, the mobile device may be similar to the mobile devices discussed above, with the addition of one or more accessories. For instance, an Eigen microphone may be attached to the above noted mobile device to form an accessory enhanced mobile device. In this way, the accessory enhanced mobile device may capture a higher quality version of the 3D soundfield rather than just using sound capture components integral to the accessory enhanced mobile device.

Example audio playback devices that may perform various aspects of the techniques described in this disclosure are further discussed below. In accordance with one or more techniques of this disclosure, speakers and/or sound bars may be arranged in any arbitrary configuration while still playing back a 3D soundfield. Moreover, in some examples, headphone playback devices may be coupled to a decoder 24 via either a wired or a wireless connection. In accordance with one or more techniques of this disclosure, a single generic representation of a soundfield may be utilized to render the soundfield on any combination of the speakers, the sound bars, and the headphone playback devices.

A number of different example audio playback environments may also be suitable for performing various aspects of the techniques described in this disclosure. For instance, a 5.1 speaker playback environment, a 2.0 (e.g., stereo) speaker playback environment, a 9.1 speaker playback environment with full height front loudspeakers, a 22.2 speaker playback environment, a 16.0 speaker playback environment, an automotive speaker playback environment, and a mobile device with ear bud playback environment may be suitable environments for performing various aspects of the techniques described in this disclosure.

In accordance with one or more techniques of this disclosure, a single generic representation of a soundfield may be utilized to render the soundfield on any of the foregoing playback environments. Additionally, the techniques of this disclosure enable a rendered to render a soundfield from a generic representation for playback on the playback environments other than that described above. For instance, if design considerations prohibit proper placement of speakers according to a 7.1 speaker playback environment (e.g., if it is not possible to place a right surround speaker), the techniques of this disclosure enable a renderer to compensate with the other 6 speakers such that playback may be achieved on a 6.1 speaker playback environment.

Moreover, a user may watch a sports game while wearing headphones. In accordance with one or more techniques of this disclosure, the 3D soundfield of the sports game may be acquired (e.g., by one or more Eigen microphones may be placed in and/or around the baseball stadium), HOA coefficients corresponding to the 3D soundfield may be obtained and transmitted to a decoder, the decoder may reconstruct the 3D soundfield based on the HOA coefficients and output the reconstructed 3D soundfield to a renderer, and the renderer may obtain an indication as to the type of playback environment (e.g., headphones), and render the reconstructed 3D soundfield into signals that cause the headphones to output a representation of the 3D soundfield of the sports game.

In each of the various instances described above, it should be understood that the audio encoding device 20 may perform a method or otherwise comprise means to perform each step of the method for which the audio encoding device 20 is configured to perform In some instances, the means may comprise one or more processors. In some instances, the one or more processors may represent a special purpose processor configured by way of instructions stored to a non-transitory computer-readable storage medium. In other words, various aspects of the techniques in each of the sets of encoding examples may provide for a non-transitory computer-readable storage medium having stored thereon instructions that, when executed, cause the one or more processors to perform the method for which the audio encoding device 20 has been configured to perform. In other instances, the processors may be substantially hardware-based and not general purpose processors.

In one or more examples, the functions described may be implemented in hardware, software, firmware, or any combination thereof. If implemented in software, the functions may be stored on or transmitted over as one or more instructions or code on a computer-readable medium and executed by a hardware-based processing unit. Computer-readable media may include computer-readable storage media, which corresponds to a tangible medium such as data storage media. Data storage media may be any available media that can be accessed by one or more computers or one or more processors to retrieve instructions, code and/or data structures for implementation of the techniques described in this disclosure. A computer program product may include a computer-readable medium.

Likewise, in each of the various instances described above, it should be understood that the audio decoding device 24 may perform a method or otherwise comprise means to perform each step of the method for which the audio decoding device 24 is configured to perform. In some instances, the means may comprise one or more processors. In some instances, the one or more processors may represent a special purpose processor configured by way of instructions stored to a non-transitory computer-readable storage medium. In other words, various aspects of the techniques in each of the sets of encoding examples may provide for a non-transitory computer-readable storage medium having stored thereon instructions that, when executed, cause the one or more processors to perform the method for which the audio decoding device 24 has been configured to perform.

By way of example, and not limitation, such computer-readable storage media can comprise RAM, ROM, EEPROM, CD-ROM or other optical disk storage, magnetic disk storage, or other magnetic storage devices, flash memory, or any other medium that can be used to store desired program code in the form of instructions or data structures and that can be accessed by a computer. It should be understood, however, that computer-readable storage media and data storage media do not include connections, carrier waves, signals, or other transitory media, but are instead directed to non-transitory, tangible storage media. Disk and disc, as used herein, includes compact disc (CD), laser disc, optical disc, digital versatile disc (DVD), floppy disk and Blu-ray disc, where disks usually reproduce data magnetically, while discs reproduce data optically with lasers. Combinations of the above should also be included within the scope of computer-readable media.

Instructions may be executed by one or more processors, such as one or more digital signal processors (DSPs), general purpose microprocessors, application specific integrated circuits (ASICs), field programmable logic arrays (FPGAs), or other equivalent integrated or discrete logic circuitry. Accordingly, the term "processor," as used herein may refer to any of the foregoing structure or any other structure suitable for implementation of the techniques described herein. In addition, in some aspects, the functionality described herein may be provided within dedicated hardware and/or software modules configured for encoding and decoding, or incorporated in a combined codec. Also, the techniques could be fully implemented in one or more circuits or logic elements.

The techniques of this disclosure may be implemented in a wide variety of devices or apparatuses, including a wireless handset, an integrated circuit (IC) or a set of ICs (e.g., a chip set). Various components, modules, or units are described in this disclosure to emphasize functional aspects of devices configured to perform the disclosed techniques, but do not necessarily require realization by different hardware units. Rather, as described above, various units may be combined in a codec hardware unit or provided by a collection of interoperative hardware units, including one or more processors as described above, in conjunction with suitable software and/or firmware.

Various aspects of the techniques have been described. These and other aspects of the techniques are within the scope of the following claims.

The invention claimed is:

1. A device comprising:

a memory configured to store a bitstream representative of an augmented higher-order ambisonic representation of a soundfield that includes an audio channel separate from the soundfield;

one or more processors coupled to the memory, and configured to:

decode the bitstream to obtain the augmented higher-order ambisonic representation of the soundfield;

obtain a spatial location at which the audio channel is located within the augmented higher-order ambisonic representation of the soundfield;

extract the audio channel from the spatial location within the augmented higher-order ambisonic representation of the soundfield;

render the augmented higher-order ambisonic representation to one or more speaker feeds;

mix the extracted audio channel with the one or more speaker feeds to obtain one or more mixed speaker feeds; and output the one or more mixed speaker feeds to reproduce the soundfield and the audio channel.

2. The device of claim 1, wherein the soundfield is in a shape of a sphere, and wherein the spatial location is located within the sphere where audio content is not usually present or of large importance to describing the soundfield.

3. The device of claim 1, wherein the one or more processors are further configured to obtain the spatial location within the soundfield based on a vector-based analysis of the soundfield.

4. The device of claim 1, wherein the augmented higher-order ambisonic representation of the soundfield comprises a plurality of higher-order ambisonic coefficients descriptive of the soundfield, and wherein the one or more processors are configured to:

transform the plurality of higher-order ambisonic coefficients from a spherical harmonic domain to a spatial domain so as to obtain an augmented spatial domain representation of the soundfield; and extract the audio channel from the spatial location within the augmented spatial domain representation of the soundfield.

5. The device of claim 1, wherein the one or more processors are configured to obtain, from the bitstream, the spatial location into which the audio channel was inserted.

6. The device of claim 1, wherein the one or more processors are further configured to obtain, from the bitstream, information descriptive of the audio channel.

7. The device of claim 6, wherein the information descriptive of the audio channel comprises one of information identifying a broadcaster, information identifying a language in which commentary present in the audio channel is spoken or information identifying a type of content present in the audio channel.

8. The device of claim 1, wherein the separate audio channel comprises one of an audio channel from a broadcaster, an audio channel obtained by a non-broadcaster, a non-English audio channel providing commentary in a non-English language, and an English audio channel providing commentary in an English language.

9. The device of claim 1, wherein the higher-order ambisonic representation of the soundfield comprises a plurality of higher-order ambisonic coefficients descriptive of an ambient component of the soundfield.

10. The device of claim 1, wherein the device comprises one of a vehicle, an audio playback sound system of a vehicle, an audio playback sound system in a home, a television, a smartphone, a tablet, a sound bar device, and headphones.

11. The device of claim 1, wherein the device comprises one or more of: a digital audio workstation, a game system, and a smartphone.

12. A method comprising:

decode a bitstream representative of an augmented higher-order ambisonic representation of a soundfield that includes an audio channel separate from the soundfield to obtain the augmented higher-order ambisonic representation;

obtaining a spatial location at which the audio channel is located within the augmented higher-order ambisonic representation of the soundfield;

extracting the audio channel from the spatial location within the augmented higher-order ambisonic representation of the soundfield;

rendering the augmented higher-order ambisonic representation to one or more speaker feeds;

mixing the extracted audio channel with the one or more speaker feeds to obtain one or more mixed speaker feeds; and outputting the one or more mixed speaker feeds to reproduce the soundfield and the audio channel.

13. The method of claim 12, wherein the soundfield is in a shape of a sphere, and wherein the spatial location is located within the sphere where audio content is not usually present or of large importance to describing the soundfield.

14. The method of claim 12, wherein obtaining the spatial location comprises obtaining the spatial location within the soundfield based on a vector-based analysis of the augmented higher-order ambisonic representation of the soundfield.

15. The method of claim 12, wherein the augmented higher-order ambisonic representation of the soundfield comprises a plurality of higher-order ambisonic coefficients descriptive of the soundfield, and wherein extracting the audio channel comprises:

transforming the plurality of higher-order ambisonic coefficients from a spherical harmonic domain to a spatial domain so as to obtain an augmented spatial domain representation of the soundfield; and extracting the audio channel from the spatial location within the augmented spatial domain representation of the soundfield.

16. The method of claim 12, wherein obtaining the spatial location comprises obtaining, from the bitstream, insertion information indicative of the spatial location to which the audio channel was inserted, wherein the insertion information comprises a V-vector identifying the spatial location to which the audio channel was inserted.

17. The method of claim 12, further comprising obtaining, from the bitstream, information descriptive of the audio channel.

18. The method of claim 17, wherein the information descriptive of the audio channel comprises one of information identifying a sportscaster, information identifying a language in which commentary present in the audio channel is spoken or information identifying a type of content present in the audio channel.

19. The method of claim 12, wherein the separate audio channel comprises one of an audio channel from a sportscaster, an audio channel obtained by a non-broadcaster, a non-English audio channel providing commentary in a non-English language, and an English audio channel providing commentary in an English language.

20. The method of claim 12, wherein the higher-order ambisonic representation of the soundfield comprises a plurality of higher-order ambisonic coefficients descriptive of an ambient component of the soundfield.

21. The method of claim 12, wherein obtaining the augmented higher-order ambisonic representation comprises obtaining, by an audio decoding device, the augmented higher-order representation, and wherein extracting the audio channel comprises extracting, by the audio decoding device, the audio channel.

22. A device comprising:

a memory configured to store a higher-order ambisonic representation of a soundfield; and one or more processors coupled to the memory, and configured to:

obtain an audio channel separate from the higher-order ambisonic representation of the soundfield; and insert the audio channel at a spatial location within the soundfield represented by the higher-order ambisonic representation of the soundfield to obtain an augmented higher-order ambisonic representation of the soundfield;

encode, by the audio encoding device, the augmented higher-order ambisonic representation to obtain a bitstream; and outputting, by the audio encoding device, the bitstream.

23. The device of claim 22, wherein the soundfield is in a shape of a sphere, and wherein the spatial location is located within the sphere where audio content is not usually present or of large importance to describing the soundfield.

24. The device of claim 22, wherein the one or more processors are configured to analyze the soundfield to identify the spatial location within the soundfield affected by masking, and insert the audio channel at the identified spatial location, and wherein the one or more processors are further configured to specify, in the bitstream, the spatial location to which the audio channel was inserted.

25. The device of claim 22, wherein the higher-order ambisonic representation of the soundfield comprises a plurality of higher-order ambisonic coefficients descriptive of the soundfield, and wherein the one or more processors are configured to:

transform the plurality of higher-order ambisonic coefficients from a spherical harmonic domain to a spatial domain so as to obtain a spatial domain representation of the soundfield;

insert the audio channel at the spatial location within the spatial domain representation of the soundfield to obtain an augmented spatial domain representation of the soundfield; and transform the augmented spatial domain representation of the soundfield from the spatial domain back to the spherical harmonic domain to obtain the augmented higher-order ambisonic representation of the soundfield.

26. The device of claim 22, wherein the one or more processors are further configured to specify, in the bitstream, the spatial location to which the audio channel was inserted.

27. The device of claim 22, wherein the one or more processors are configured to:

analyze the soundfield to identify non-salient areas within the soundfield;

zero-out the identified non-salient areas; and insert the audio channel at the identified non-salient area.

28. A method comprising:

capturing, by a microphone, audio data representative of the higher-order ambisonic representation of the soundfield obtaining, by an audio encoding device coupled to the microphone, an audio channel separate from a higher-order ambisonic representation of a soundfield; and inserting, by the audio encoding device, the audio channel at a spatial location within the soundfield represented by the higher-order ambisonic representation of the soundfield to obtain an augmented higher-order ambisonic representation of the soundfield;

encoding, by the audio encoding device, the augmented higher-order ambisonic representation to obtain a bitstream; and outputting, by the audio encoding device, the bitstream.

29. The method of claim 28, wherein the soundfield is in a shape of a sphere, and wherein the spatial location is located within the sphere where audio content is not usually present or of large importance to describing the soundfield.

30. The method of claim 28, wherein inserting the audio channel comprises:

analyzing the soundfield to identify the spatial location within the soundfield affected by masking; and inserting the audio channel at the identified spatial location.

31. The method of claim 28, wherein the higher-order ambisonic representation of the soundfield comprises a plurality of higher-order ambisonic coefficients descriptive of the soundfield, and wherein inserting the audio channel comprises:

transforming the plurality of higher-order ambisonic coefficients from a spherical harmonic domain to a spatial domain so as to obtain a spatial domain representation of the soundfield;

inserting the audio channel at the spatial location within the spatial domain representation of the soundfield to obtain an augmented spatial domain representation of the soundfield; and transforming the augmented spatial domain representation of the soundfield from the spatial domain back to the spherical harmonic domain to obtain the augmented higher-order ambisonic representation of the soundfield.

32. The method of claim 28, further comprising specifying, in the bitstream that includes the higher-order ambisonic representation of the soundfield, insertion information indicative of the spatial location to which the audio channel was inserted, wherein the insertion information comprises a V-vector identifying the spatial location to which the audio channel was inserted.

33. The method of claim 28, wherein inserting the audio channel comprises: analyzing the soundfield to identify non-salient areas within the soundfield;

zeroing-out the identified non-salient areas; and inserting the audio channel at the identified non-salient area, and wherein the method further comprises specifying, in the bitstream, the spatial location into which the audio channel was inserted.

* * * * *